US011825264B2

(12) United States Patent
Katagiri

(10) Patent No.: US 11,825,264 B2
(45) Date of Patent: Nov. 21, 2023

(54) SOUND PICK-UP APPARATUS, STORAGE MEDIUM, AND SOUND PICK-UP METHOD

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 194 days.

(21) Appl. No.: 17/629,564

(22) PCT Filed: Apr. 14, 2020

(86) PCT No.: PCT/JP2020/016354
§ 371 (c)(1),
(2) Date: Jan. 24, 2022

(87) PCT Pub. No.: WO2021/019844
PCT Pub. Date: Feb. 4, 2021

(65) Prior Publication Data

US 2022/0272443 A1 Aug. 25, 2022

(30) Foreign Application Priority Data

Jul. 29, 2019 (JP) ..... 2019-139078

(51) Int. Cl.
*H04R 1/40* (2006.01)
*H04R 3/00* (2006.01)
(Continued)

(52) U.S. Cl.
CPC ..... *H04R 1/406* (2013.01); *G10L 21/0208* (2013.01); *H04R 3/005* (2013.01);
(Continued)

(58) Field of Classification Search
CPC .. H04R 1/406; H04R 3/005; H04R 2201/401; G10L 21/0208; G10L 2021/02166
See application file for complete search history.

(56) References Cited

U.S. PATENT DOCUMENTS

2017/0289677 A1 10/2017 Katagiri
2018/0242078 A1 8/2018 Katagiri

FOREIGN PATENT DOCUMENTS

JP 2010-026485 A 2/2010
JP 2014-072708 A 4/2014
(Continued)

OTHER PUBLICATIONS

English machine translation of JP 2015-023508 A (Katagiri, Kazuhiro; Sound Gathering Device and Program; published Feb. 2015) (Year: 2015).*

(Continued)

*Primary Examiner* — Mark Fischer
(74) *Attorney, Agent, or Firm* — Rabin & Berdo, P.C.

(57) ABSTRACT

To perform an efficient and stable area sound pick-up process. The present invention relates to a sound pick-up apparatus. The sound pick-up apparatus according to the present invention includes: a means for acquiring target direction signals on the basis of beamformers of input signals supplied by a plurality of microphone arrays; a means for calculating correction coefficients for approximating target area sound components to each other, the target area sound components being included in the respective target direction signals of the plurality of microphone arrays; a means for selecting a main microphone array on the basis of the correction coefficients, the main microphone array being to be used as a criterion for extracting target area sound; and a means for correcting the target direction signals of the respective microphone arrays by using the correction coefficients with respect to the main microphone array, and
(Continued)

extracting the target area sound on the basis of the corrected target direction signals of the respective microphone arrays.

8 Claims, 16 Drawing Sheets

(51) Int. Cl.
*G10L 21/0208* (2013.01)
*G10L 21/0216* (2013.01)

(52) U.S. Cl.
CPC ..... *G10L 2021/02166* (2013.01); *H04R 2201/401* (2013.01)

(56) References Cited

FOREIGN PATENT DOCUMENTS

| | | | |
|---|---|---|---|
| JP | 2015-023508 | A | 2/2015 |
| JP | 2017-183902 | A | 10/2017 |
| JP | 2018-132737 | A | 8/2018 |
| JP | 2019-057901 | A | 4/2019 |

OTHER PUBLICATIONS

Futoshi Asano, "Sound technology series 16: Array signal processing for acoustics: localization, tracking and separation of sound sources", The Acoustical Society of Japan Edition, Corona publishing Co. Ltd, publication date: Feb. 25, 2011, with its partial English translation.

* cited by examiner

SOUND PICK-UP APPARATUS, STORAGE MEDIUM, AND SOUND PICK-UP METHOD

TECHNICAL FIELD

The present invention relates to a sound pick-up apparatus, a storage medium, and a sound pick-up method. For example, the present invention is applicable to a system of emphasizing sounds in a specific area and reducing sounds in the other areas.

BACKGROUND ART

As technology that collects and separates only sounds in a specific direction in an environment in which a plurality of sound sources are present, there is a beamformer (which will be referred to as "BF") using microphone arrays. The BF is technology that forms directionality by using time difference in signals arriving at respective microphones (see Non Patent Literature 1).

Conventionally, the BF roughly comes in two types: an addition-type and a subtraction-type. In particular, a subtraction-type BF can advantageously form directionality with a smaller number of microphones as compared to an addition-type BF.

FIG. 13 is a block diagram illustrating a configuration of a subtraction-type BF 200 including two microphones M.

FIG. 14 are explanatory diagrams illustrating examples of directional filters formed by the subtraction-type BF 200 including the two microphones M1 and M2.

The subtraction-type BF 200 first uses a delayer 210 to calculate a signal time difference in sounds in a target direction (which will be referred to as "target sounds") which arrive at respective microphones M1 and M2, and then matches phases of the target sounds by adding delay. The above-described time difference is calculated on the basis of the following expression (1).

In the expression (1), "d" represents a distance between the microphones M1 and M2, "c" represents speed of sound, and "$\tau_i$" represents a delay amount. Further "$\theta_L$" represents an angle from a vertical direction to the target direction with respect to a straight line connecting the microphones (M1 and M2).

In addition, here, if there is a dead angle in the direction of the microphone M1 with respect to the center of the microphones M1 and M2, the delayer 210 performs a delay process on an input signal $x_1(t)$ of the microphone M1. Afterwards, the subtraction-type BF 200 performs a process (subtraction process) in accordance with the following expression (2).

The subtraction-type BF 200 can similarly perform the process even in a frequency domain. In that case, the expression (2) is changed into the following expression (3).

[Math. 1]

$$\tau_L=(d \sin \theta_L)/c \tag{1}$$

$$m(t)=x_2(t)-x_1(t-\tau_L) \tag{2}$$

$$M(\omega)=X_2(\omega)-e^{-j\omega\tau_L}X_1(\omega) \tag{3}$$

Here, if $\theta_L=\pm\pi/2$, the subtraction-type BF 200 forms cardioid unidirectionality as illustrated in FIG. 14A. Alternatively, if θL=0 or π, the subtraction-type BF 200 forms 8-shaped bidirectionality as illustrated in FIG. 14B.

Here, a filter that forms unidirectionality from input signals will be referred to as "unidirectional filter," and a filter that forms bidirectionality will be referred to as "bidirectional filter."

In addition, a subtractor 220 can form directionality that is strong in a dead angle of bidirectionality by using a spectral subtraction (which will be simply referred to as "SS"). By using SS, the directionality is formed in all the frequency bands or a specified frequency band in accordance with the following expression (4).

The following expression (4) uses an input signal $X_1$ of the microphone M1, but it is also possible to attain the similar advantageous effects by using an input signal $X_2$ of the microphone M2. In the expression (4), β represents a coefficient for adjusting the strength of SS. In addition, if the subtraction process yields a negative value, the subtractor 220 performs a flooring process of replacing the negative value with 0 or a value obtained by reducing an original value. By using the above-described processing method performed by the subtraction-type BF 200, it is possible to emphasize target sounds by extracting sounds in directions other than a target direction (which will be referred to as "non-target sounds") by using characteristics of the bidirectionality, and subtracting the amplitude spectrum of the extracted non-target sounds from the amplitude spectrum of the input signals.

[Math. 2]

$$Y(n)=X_1(n)-\beta M(n) \tag{4}$$

In the case of collecting only sounds in a specific area (which will be referred to as "target area sounds") by using the subtraction-type BF alone, the subtraction-type BF would also probably collect sounds from sound sources around the area (which will be referred to as "non-target area sounds"). Accordingly, Patent Literature 1 proposes a method (which will be referred to as "area sound pick-up method") that collects target area sounds by directing directionalities from different directions to a target area, and causing the directionalities to intersect in the target area with a plurality of microphone arrays. When using the area sound pick-up, the amplitude spectrum ratio of target area sounds included in the BF output from each microphone array is first estimated, and then the ratio is used as a correction coefficient.

For example, if two microphone arrays are used, the correction coefficients of the target area sound amplitude spectra are calculated on the basis of a combination of the following expressions (5) and (6), or a combination of the following expressions (7) and (8). In the expressions (5) to (8), "$Y_{1k}(n)$" represents an amplitude spectrum of BF output of a first microphone array, "$Y_{2k}(n)$" represents an amplitude spectrum of BF output of a second microphone array, "N" represents the total number of frequency bins, and "K" represents a frequency. In addition, in the expressions (5) to (8), "$\alpha_1(n)$" and "$\alpha_2(n)$" represent amplitude spectrum correction coefficients for the respective BF outputs. Further, "mode" represents a mode value, and "median" represents a median value.

[Math. 3]

$$\alpha_1(n) = \text{mode}\left(\frac{Y_{2k}(n)}{Y_{1k}(n)}\right) \quad k = 1, 2, \ldots, N \tag{5}$$

-continued $$\alpha_2(n) = \text{mode}\left(\frac{Y_{1k}(n)}{Y_{2k}(n)}\right) \quad k = 1, 2, \ldots, N \tag{6}$$

$$\alpha_1(n) = \text{median}\left(\frac{Y_{2k}(n)}{Y_{1k}(n)}\right) \quad k = 1, 2, \ldots, N \tag{7}$$

$$\alpha_2(n) = \text{median}\left(\frac{Y_{1k}(n)}{Y_{2k}(n)}\right) \quad k = 1, 2, \ldots, N \tag{8}$$

The subtractor 220 performs the above-described process to find the correction coefficients $\alpha_1(n)$ and $\alpha_2(n)$, correct the respective BF outputs by using the found correction coefficients, perform the SS, and extract the non-target area sounds in the target area direction. In addition, it is possible for the subtractor 220 to extract target area sounds by performing the SS of the extracted non-target area sounds from the respective BF outputs.

For example, to extract a non-target area sound $N_1(n)$ in the target area direction seen from the first microphone array, the subtraction-type BF 200 performs the SS of a BF output $Y_2(n)$ of the second microphone array which has been multiplied by an amplitude spectrum correction coefficient $\alpha_2$ from a BF output $Y_1(n)$ of the first microphone array as shown in the following expression (9). In a similar way, the subtraction-type BF 200 extracts a non-target area sound $N_2(n)$ in the target area direction seen from the second microphone array in accordance with the following expression (10).

Afterwards, the subtraction-type BF 200 performs the SS of the non-target area sounds from the respective BF outputs in accordance with the following expression (11) or (12) to extract the target area sounds. Note that, the expression (11) represents a process of extracting a target area sound on the basis of the first microphone array. In addition, the expression (12) represents a process of extracting a target area sound on the basis of the second microphone array. In the expressions (11) and (12), $\gamma_1(n)$ and $\gamma_2(n)$ represent coefficients for changing the strength at the time of the SS.

[Math. 4]

$$N_1(n)=(n)-\alpha_2(n)Y_2(n) \tag{9}$$

$$N_2(n)=Y_2(n)-\alpha_1(n)Y_1(n) \tag{10}$$

$$Z_1(n)=(n)-Y_1(n)-\gamma_1(n)N_1(n) \tag{11}$$

$$Z_2(n)=Y_2(n)-\gamma_2(n)N_2(n) \tag{12}$$

CITATION LIST

Patent Literature

Patent Literature 1: JP 2014-072708A

Non-Patent Literature

Non Patent Literature 1: Futoshi Asano (Author), "Sound technology series 16: Array signal processing for acoustics: localization, tracking and separation of sound sources," The Acoustical Society of Japan Edition, Corona publishing Co. Ltd, publication date: Feb. 25, 2011.

DISCLOSURE OF INVENTION

Technical Problem

In the case where a sound pick-up apparatus to which the technology described in Patent Literature 1 is applied extracts a target area sound by using the expression (11) on the basis of the microphone array MA1, distance decay occurs and an output sound gets smaller when a target area sound source moves within a target area and gets away from the microphone array MA1. In addition, sound is directional. Therefore, output sound volume of the sound pick-up apparatus to which the technology described in Patent Literature 1 is applied varies depending of a direction of a face of a speaker. Accordingly, when using the sound pick-up apparatus to which the technology described in Patent Literature 1 is applied, it may be impossible for a listener to hear sound stably if volume of the sound gets smaller depending on a position, a direction, or the like of a target area sound source within a target area.

In addition, the sound pick-up apparatus to which the technology described in Patent Literature 1 is applied calculates an SN ratio between the extracted target area sound and a non-target area sound, and select output having a highest SN ratio.

However, sometimes the sound pick-up apparatus to which the technology described in Patent Literature 1 is applied may select output that has a higher SN ratio but has smaller target area sound volume. Therefore, the sound pick-up apparatus to which the technology described in Patent Literature 1 is applied does not assure stability of the sound volume. In addition, as represented by expressions (11) and (12), the sound pick-up apparatus to which the technology described in Patent Literature 1 is applied extracts target area sounds on the basis of all microphone arrays and then selects final output. This results in increase the number of times of a process to the number corresponding to the number of microphone arrays.

In view of the aforementioned issues, a sound pick-up apparatus, program, method that make it possible to perform an efficient and stable area sound pick-up process has been desired.

Solution to Problem

A sound pick-up apparatus according to the first present invention is characterized by including (1) a directionality formation means for forming directionality in a target area direction in which a target area is present by using a beamformer with regard to a signal based on an input signal supplied by each of a plurality of microphone arrays, and acquiring a target direction signal from the target area direction with regard to each of the plurality of microphone arrays, (2) a correction coefficient calculation means for calculating correction coefficients for approximating target area sound components to each other, the target area sound components being included in the respective target direction signals of the plurality of microphone arrays, (3) a selection means for selecting a main microphone array on a basis of the correction coefficients calculated by the correction coefficient calculation means, the main microphone array being to be used as a criterion for extracting target area sound, and (4) a target area sound extraction means for correcting the target direction signals of the respective microphone arrays by using the correction coefficients calculated by the correction coefficient calculation means with respect to a microphone array selected as the main microphone array by the selection means, and extracting the target area sound on a basis of the corrected target direction signals of the respective microphone arrays.

A computer-readable storage medium according to the second present invention having recorded thereon a sound pick-up program that causes a computer to functions as (1)

a directionality formation means for forming directionality in a target area direction in which a target area is present by using a beamformer with regard to a signal based on an input signal supplied by each of a plurality of microphone arrays, and acquiring a target direction signal from the target area direction with regard to each of the plurality of microphone arrays, (2) a correction coefficient calculation means for calculating correction coefficients for approximating target area sound components to each other, the target area sound components being included in the respective target direction signals of the plurality of microphone arrays, (3) a selection means for selecting a main microphone array on a basis of the correction coefficients calculated by the correction coefficient calculation means, the main microphone array being to be used as a criterion for extracting target area sound, and (4) a target area sound extraction means for correcting the target direction signals of the respective microphone arrays by using the correction coefficients calculated by the correction coefficient calculation means with respect to a microphone array selected as the main microphone array by the selection means, and extracting the target area sound on a basis of the corrected target direction signals of the respective microphone arrays.

A sound pick-up method according to the third present invention that is performed by a sound pick-up apparatus, the sound pick-up method is characterized by including (1) a directionality formation means; a correction coefficient calculation means; a selection means; and a target area sound extraction means, (2) wherein the directionality formation means forms directionality in a target area direction in which a target area is present by using a beamformer with regard to a signal based on an input signal supplied by each of a plurality of microphone arrays, and acquires a target direction signal from the target area direction with regard to each of the plurality of microphone arrays, (3) the correction coefficient calculation means calculates correction coefficients for approximating target area sound components to each other, the target area sound components being included in the respective target direction signals of the plurality of microphone arrays, (4) the selection means selects a main microphone array on a basis of the correction coefficients calculated by the correction coefficient calculation means, the main microphone array being to be used as a criterion for extracting target area sound, and (5) the target area sound extraction means corrects the target direction signals of the respective microphone arrays by using the correction coefficients calculated by the correction coefficient calculation means with respect to a microphone array selected as the main microphone array by the selection means, and extracts the target area sound on a basis of the corrected target direction signals of the respective microphone arrays.

Advantageous Effects of Invention

When using the present invention, it is possible to perform an efficient and stable area sound pick-up process.

MODE(S) FOR CARRYING OUT THE INVENTION

(A) First Embodiment

Hereinafter, a first embodiment of a sound pick-up apparatus, a storage medium, and a sound pick-up method according to the present invention will be described with reference to drawings.

(A-1) Configuration According to First Embodiment

Figure 1:
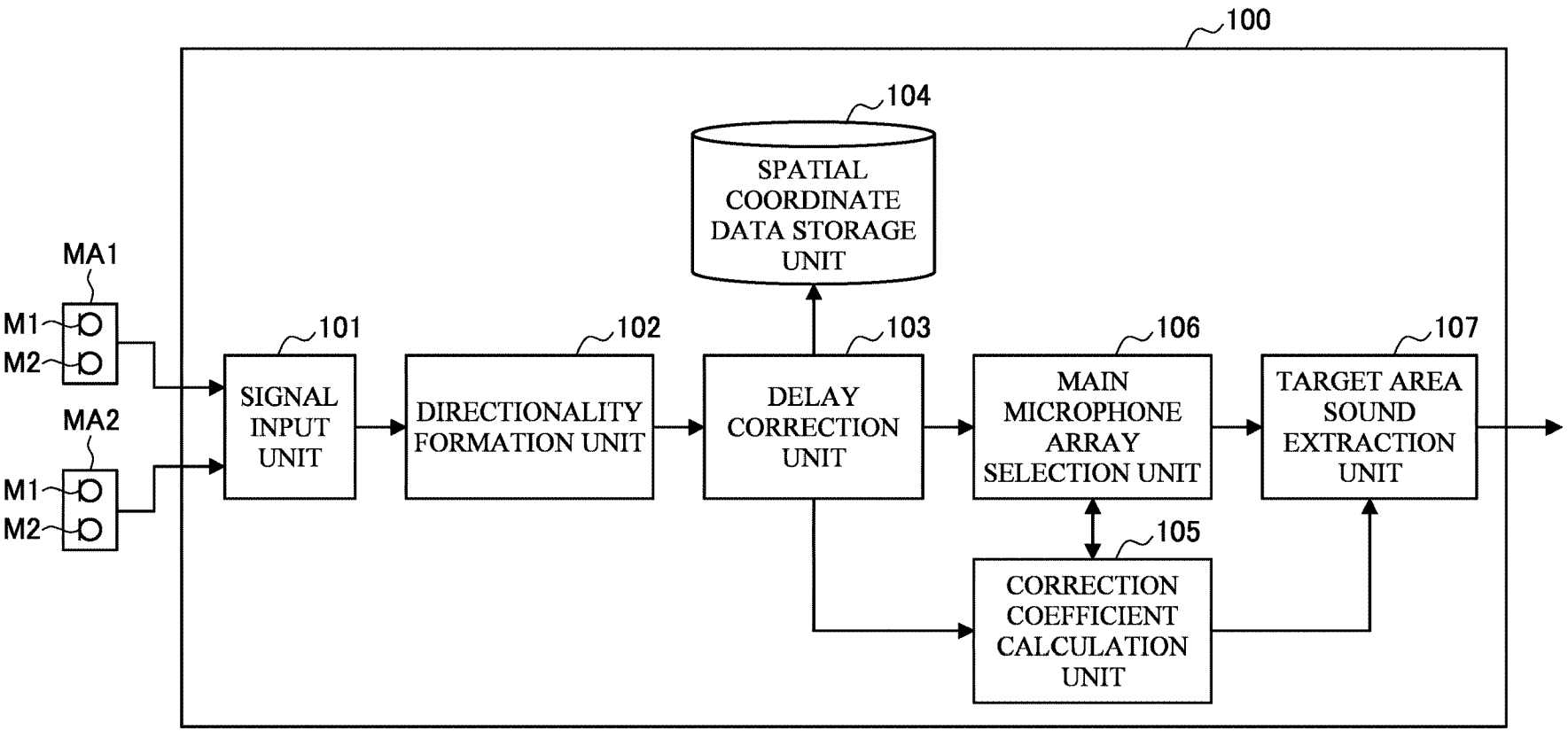
FIG. 1 is a block diagram illustrating a functional configuration of a sound pick-up apparatus according to a first embodiment.

FIG. 1 is a block diagram illustrating a functional configuration of a sound pick-up apparatus 100 according to a first embodiment.

The sound pick-up apparatus 100 uses two microphone arrays MA (MA1 and MA2) to perform a target area sound pick-up process of collecting target area sounds from a sound source in a target area. Hereinafter, the microphone array MA1 is also referred to as a "first microphone array MA1", and the microphone array MA2 is also referred to as a "second microphone array MA2".

The microphone arrays MA1 and MA2 are disposed in given places in a space including the target area. The microphone arrays MA1 and MA2 can be disposed at any positions with respect to the target area as long as the directionalities overlap with each other only in the target area. For example, the microphone arrays MA1 and MA2 may be disposed to face each other across the target area. Each of the microphone arrays includes two or more microphones M, and collects acoustic signals through the respective microphones M. The present embodiment will be described on the assumption that two microphones M1 and M2 for collecting the acoustic signals are disposed in each of the microphone arrays. In other words, in the present embodiment, it is assumed that each of the microphone arrays constitutes a 2-ch microphone array. A distance between the two microphones M1 and M2 is not limited. In the example according to the present embodiment, the distance between the two microphones M1 and M2 is assumed to be 3 cm. Note that the number of microphone arrays MA is not limited to two. If there are a plurality of target areas, it is necessary to dispose a sufficient number of the microphone arrays MA to cover all of the areas.

Next, an internal configuration of the sound pick-up apparatus 100 will be described with reference to FIG. 1 and FIG. 2.

As illustrated in FIG. 1, the sound pick-up apparatus 100 includes a signal input unit 101, a directionality formation unit 102, a delay correction unit 103, a spatial coordinate data storage unit 104, a correction coefficient calculation unit 105, a main microphone array selection unit 106, and a target area sound extraction unit 107.

Next, a hardware configuration of the sound pick-up apparatus 100 will be described with reference to FIG. 2.

Figure 2:
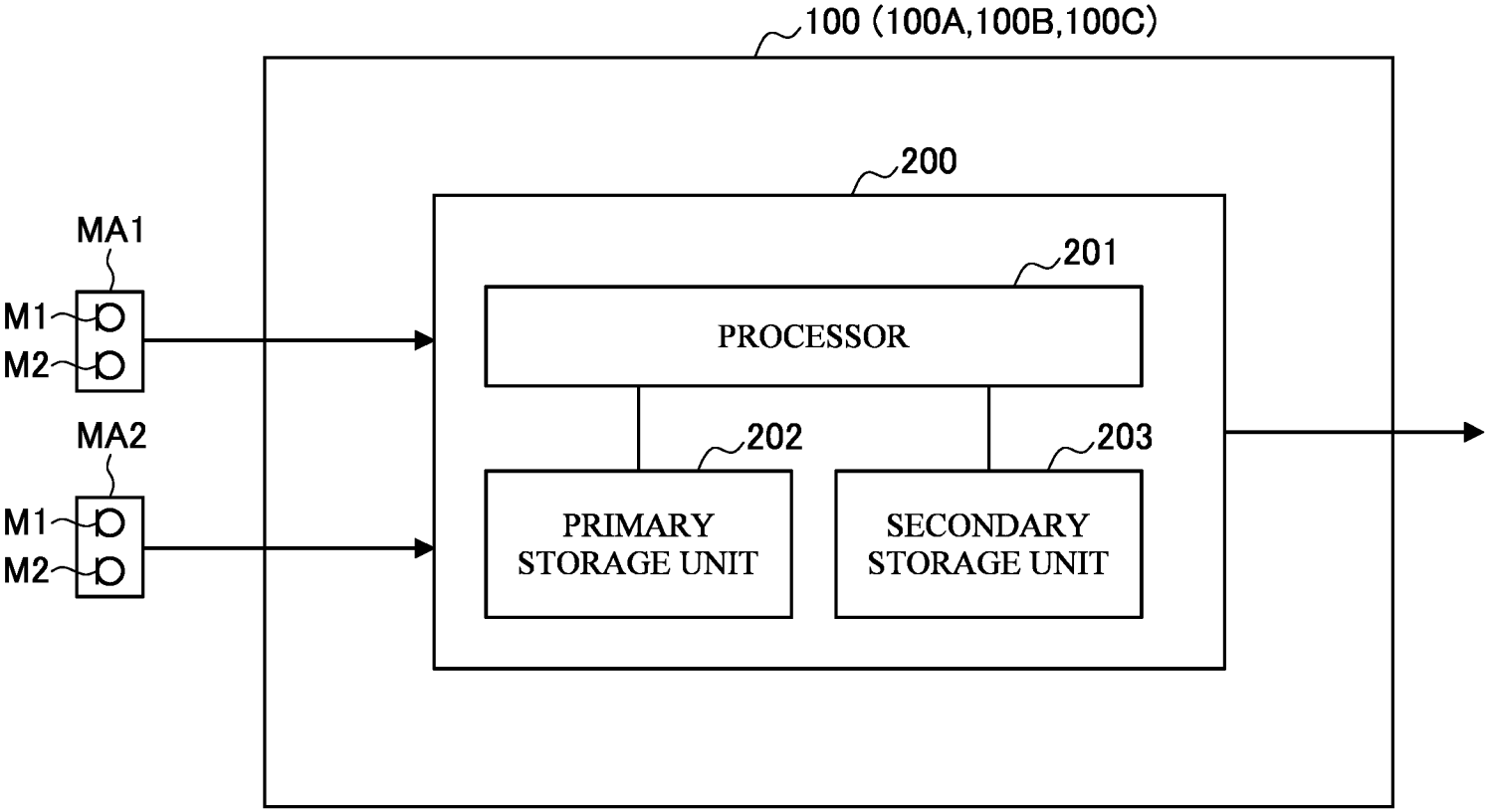
FIG. 2 is a block diagram illustrating an example of a hardware configuration of the sound pick-up apparatus according to the first embodiment.

FIG. 2 is a block diagram illustrating an example of the hardware configuration of the sound pick-up apparatus 100.

The sound pick-up apparatus 100 may be entirely configured with hardware (such as an exclusive chip), or may be configured with software (program) for a part or all. The sound pick-up apparatus 100 may be configured, for example, by installing a program (including a sound pick-up program according to an embodiment) in a computer including a processor and a memory.

FIG. 2 illustrates an example of a hardware configuration when the sound pick-up apparatus 100 is configured by using software (a computer).

The sound pick-up apparatus 100 illustrated in FIG. 2 includes a computer 200 in which programs (including the sound pick-up program according to the present embodiment) are installed as a hardware structural element. In addition, the computer 200 may be a computer dedicated to the sound pick-up program, or may be configured to be shared with a program of another function.

The computer 200 illustrated in FIG. 2 includes a processor 201, a primary storage unit 202, and a secondary storage unit 203. The primary storage unit 202 is a storage means that functions as work memory. For example, high-speed operation memory such as dynamic random-access memory (DRAM) is applicable. The secondary memory 203 is a storage means (storage medium) for storing various kinds of data such as an operating system (OS) and program data (including data of the sound pick-up program according to the present embodiment). For example, non-volatile memory such as FLASH memory or an HDD is applicable. When the processor 201 is activated, the computer 200 according to the present embodiment reads the OS or the program (including the sound pick-up program according to the present embodiment) recorded on the secondary storage unit 203, and deploys it on the primary storage unit 202.

Note that, the specific configuration of the computer 200 is not limited to the configuration illustrated in FIG. 2. Various kinds of configurations are applicable. For example, it is possible to omit the secondary storage unit 203 if the primary storage unit 202 is non-volatile memory (such as FLASH memory, for example).

(A-2) Operation According to First Embodiment

Next, operation of the sound pick-up apparatus 100 according to the first embodiment configured as described above (a sound pick-up method according to the first embodiment) will be described.

The signal input unit 101 performs a process of converting acoustic signals collected through the respective microphone arrays from analog signals to digital signals and inputting the converted signals. Afterwards, the signal input unit 101 converts the input signals (digital signals) from the time domain to the frequency domain by using fast Fourier transform, for example. Hereinafter, the respective input signals of the microphones M1 and M2 in the frequency domain of the microphone arrays are referred to as $X_1$ and $X_2$.

The directionality formation unit 102 uses a BF and forms directionalities in a target area direction in accordance with the expression (4) with regard to the input signals of the respective microphone arrays. Hereinafter, respective amplitude spectra of BF outputs of the microphone arrays MA1 and MA2 will be referred to as $Y_{1k}(n)$ and $Y_{2k}(n)$.

The delay correction unit 103 calculates and corrects delay caused by difference in a distance between the target area and each microphone array. The delay correction unit 103 first acquires positions of the target area and the microphone arrays from the spatial coordinate data 104, and calculates difference in arrival time between the target area sounds arriving at the respective microphone arrays. Next, the delay correction unit 103 adds delay on the basis of a microphone array disposed at the farthest position from the target area in a manner that the target area sounds concurrently arrive at all the microphone arrays.

The spatial coordinate data storage unit 104 stores positional information on all the target areas, respective microphone arrays, and microphones of each of the microphone arrays. Note that, spatial coordinate data is not necessary in the case where the delay correction unit 103 does not have to perform the process.

The correction coefficient calculation unit 105 calculates the amplitude spectrum correction coefficients for equalizing (approximating) the amplitude spectra of the target area sound components included in the respective BF outputs. Hereinafter, respective amplitude spectrum correction coefficients of the BF outputs of the microphone arrays MA1 and MA2 are referred to as $\alpha_1(n)$ and $\alpha_2(n)$. The correction coefficient calculation unit 5 calculates the amplitude spectrum correction coefficients in accordance with a set of the expressions (5) and (6) or a set of the expressions (7) and (8).

Here, in the case of setting the main microphone array to the microphone array MA1 first, the correction coefficient calculation unit 105 calculates the amplitude spectrum correction coefficient $\alpha_2(n)$ by using the expressions (6) and (8). Subsequently, the correction coefficient calculation unit 105 treats the microphone array MA2 as the main microphone array and calculates the amplitude spectrum correction coefficient $\alpha_1(n)$ by using the expression (5) and (7) in the case where the main microphone array selection unit 106 issues an instruction (performs control). Note that, the main microphone array set by the correction coefficient calculation unit 105 first is not limited to the microphone array MA1. Any microphone array is also applicable.

The main microphone array selection unit 106 selects one of the microphone arrays as the main microphone array on the basis of the amplitude spectrum correction coefficients calculated by the correction coefficient calculation unit 105. Details of the main microphone array selection process performed by the main microphone array selection unit 106 will be described later.

The target area sound extraction unit 107 treats the microphone array selected by the main microphone array selection unit 106 as the main microphone array, and extracts the target area sound. In the case where the microphone array MA1 is selected as the main microphone array, the target area sound extraction unit 107 performs the SS of the respective BF outputs in accordance with the expression (9) by using the calculated amplitude spectrum correction coefficient $\alpha_2(n)$, and extracts non-target area sound present in the target area direction. In addition, the target area sound extraction unit 107 extracts the target area sound by performing the SS of the extracted non-target area sound from the respective BF outputs in accordance with the expression (11). In the case where the microphone array MA2 is selected as the main microphone array, the target area sound extraction unit 107 extracts the non-target area sounds present in the target area direction by performing the SS of the respective BF outputs in accordance with the expression (10) using the amplitude spectrum correction coefficient $\alpha_1(n)$, and extracts the target area sound by performing the SS of the extracted non-target area sounds from the respective BF outputs in accordance with the expression (12).

Next, details of the main microphone array selection process performed by the sound pick-up apparatus 100 according to the first embodiment will be described.

In the case of performing the area sound pick-up process using the predefined main microphone array as described above, sometimes amount of target area sound components (intensity of the target area sound components) included in the beamformer output of the main microphone may vary depending on the position and direction of the speaker existing in the target area. Such variation can be confirmed by an amplitude spectrum correction coefficient calculated on the basis of the ratio of amplitude spectrum between the target area sounds included in the BF outputs of the respective microphone arrays.

For example, if the amplitude spectrum correction coefficient $\alpha_2(n)$ is 1 or more, this indicates that an amplitude spectrum (component of target area sound) of a target area sound included in the microphone array MA1 is larger than an amplitude spectrum of a target area sound included in the microphone array MA2. On the other hand, if the target area sound amplitude spectrum correction coefficient $\alpha_2(n)$ is less than 1, this indicates that an amplitude spectrum of a target area sound included in the microphone array MA1 is smaller than an amplitude spectrum of a target area sound included in the microphone array MA2. In other words, when the main microphone array is selected depending on the target area sound amplitude spectrum correction coefficient $\alpha_2(n)$, a target area sound having larger sound volume is selected from among the target area sounds included in the microphone array MA1 and the microphone array MA2. This results in stable sound pick-up characteristics of the extracted target area sound.

Next, with reference to FIG. 3 and FIG. 4, the above-described change in the sound pick-up characteristics by switching the main microphone array depending on the target area sound amplitude spectrum correction coefficient will be described.

Figure 3:
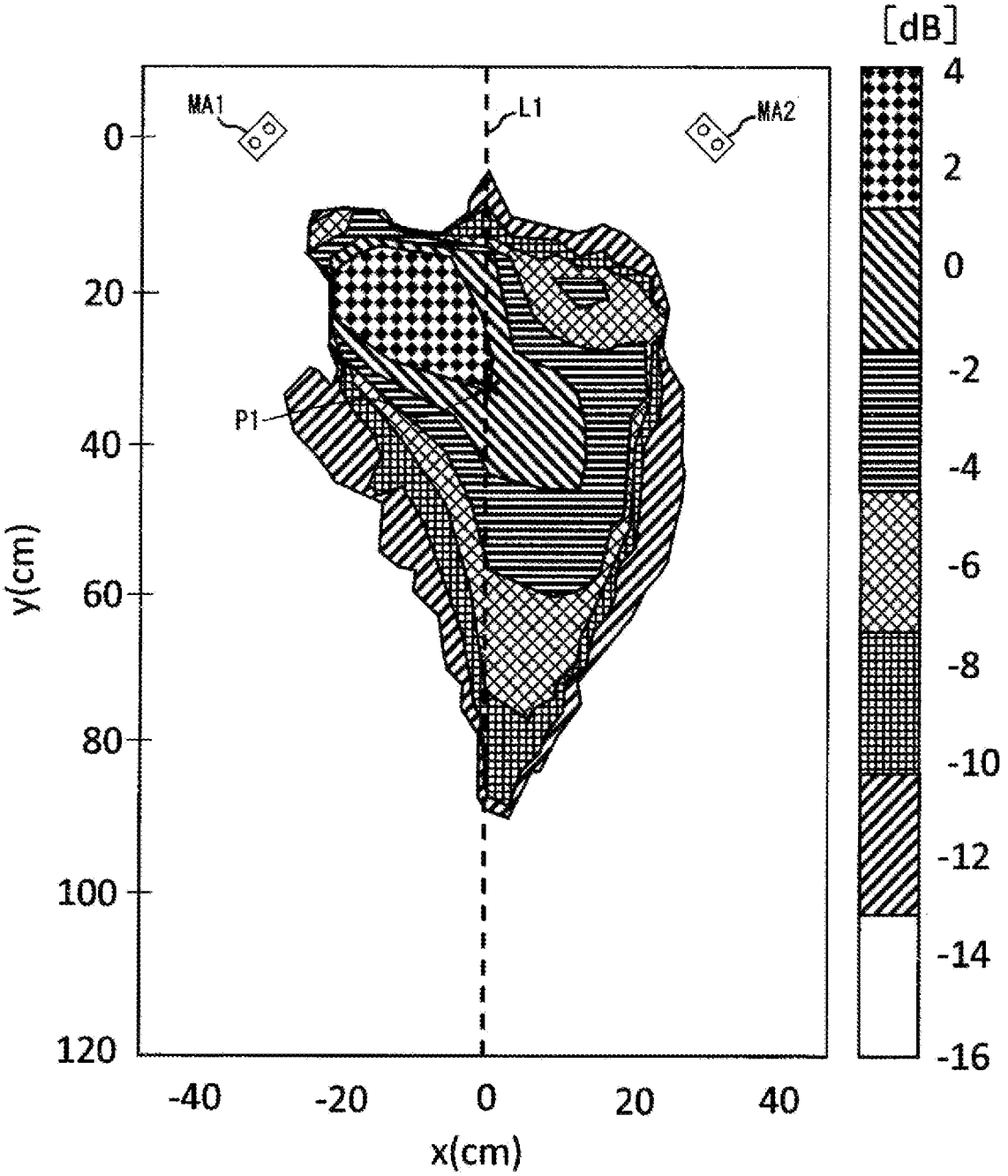
FIG. 3 is a diagram illustrating a result (part 1) obtained by simulating sound pick-up characteristics of area sound pick-up using a beamformer.

FIG. 3 illustrates a graph indicating an example (simulation result) of the sound pick-up characteristics (intensity of collected target area sound) of respective areas obtained on the basis of input signal samples of the respective microphone arrays in the case where the main microphone array is fixed. FIG. 4 illustrates a graph indicating an example (simulation result) of the sound pick-up characteristics of the same input signal samples obtained in the case of selecting (switching) the main microphone array on the basis of the target area sound amplitude spectrum correction coefficients.

Figure 4:
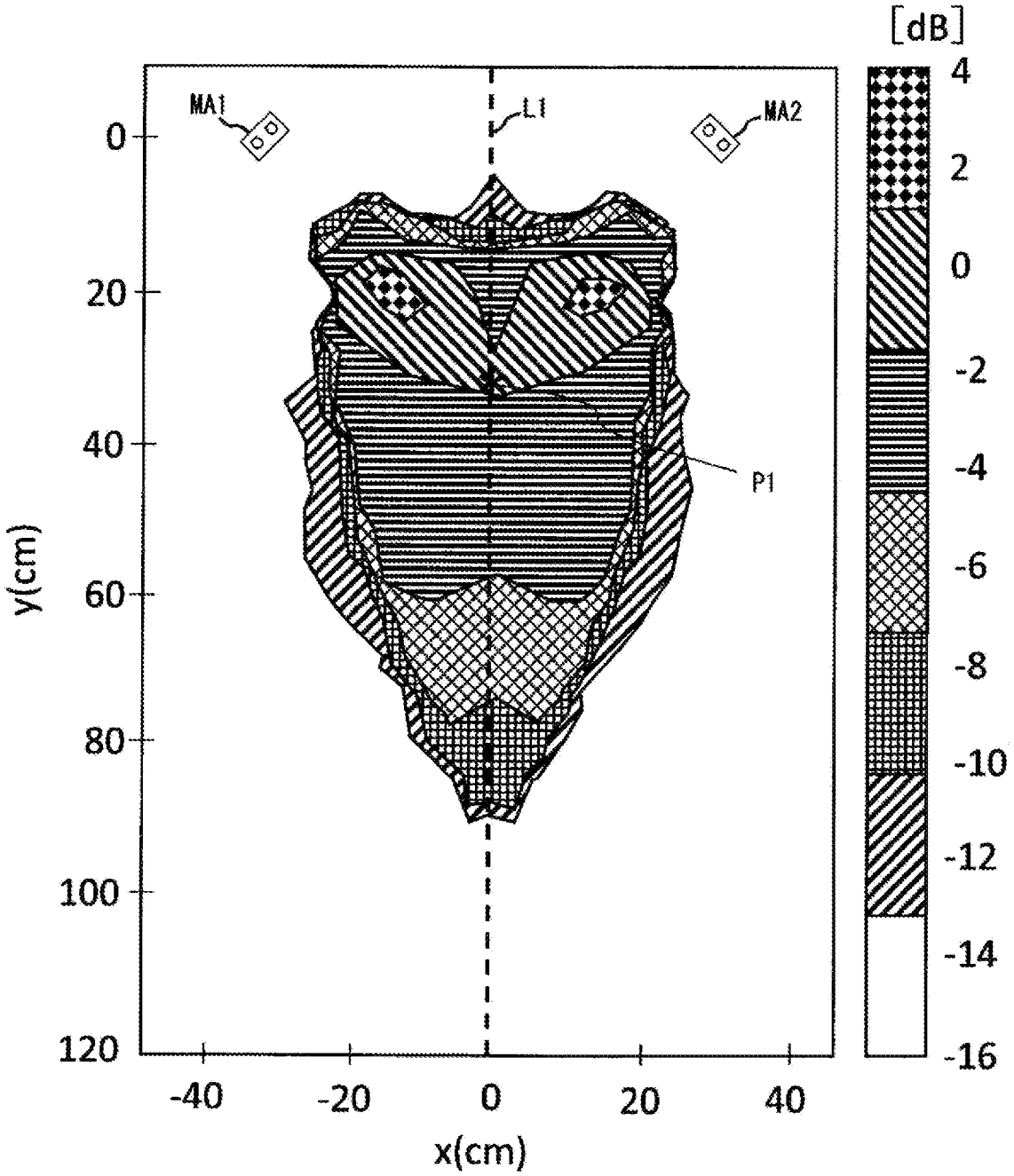
FIG. 4 is a diagram illustrating a result (part 2) obtained by simulating sound pick-up characteristics of area sound pick-up using a beamformer.

FIG. 3 and FIG. 4 illustrate positions of the microphone arrays MA1 and MA2 and a point of intersection P1 between directionalities of BFs of the microphone arrays MA1 and MA2. In addition, the FIG. 3 and FIG. 4 also illustrate sound pick-up characteristics of the target area sound around the point of intersection P1 (intensity of target area sound amplitude spectrum in units of "dB". Hereinafter, the intensity will be referred to as "sound pick-up intensity"). FIG. 3 and FIG. 4 illustrate patterns depending on values of the sound pick-up intensity. The values of the sound pick-up intensity corresponding to the respective patterns are illustrated on the right side of FIG. 3 and FIG. 4. FIG. 3 and FIG. 4 also illustrate a center line L1 that is perpendicular to a line connecting the microphone array MA1 with the microphone array MA2 at a midway point between the microphone arrays MA1 and MA2. The point of intersection P1 is assumed to be present on the center line L1.

In the case of the simulation result (sound pick-up result obtained by using a conventional sound pick-up apparatus) illustrated in FIG. 3, the sound pick-up characteristics (sound pick-up intensity) is biased toward the microphone array MA1, and sometimes an output level decreases depending on the position of the speaker and the direction of the face of the speaker. In other words, in the case of using the conventional sound pick-up apparatus, there is a possibility that it is difficult for the listener to hear contents of the sound pick-up result, and a speech recognition rate drops when the sound pick-up result is input to a speech recognition process. In other words, in the case of using the conventional sound pick-up apparatus, a sweet spot of the sound pick-up characteristics is not symmetric (bilaterally symmetric) about the center line L1 depending on the position of the speaker and the direction of the face of the speaker. Therefore, sometimes it is not possible to set (adjust) the sound pick-up area and perform the stable sound pick-up process.

On the other hand, in the case of the simulation result illustrated in FIG. 4 (sound pick-up result obtained by using the sound pick-up apparatus 100 according to the present embodiment), the sweet spot of the sound pick-up characteristics is symmetric (bilaterally symmetric) about the center line L1. In other words, the simulation result illustrated in FIG. 4 indicates that the sound pick-up apparatus 100 according to the present embodiment provides the sweet spot where it is possible to stably collect sound. In addition, the simulation result illustrated in FIG. 4 indicates that the sound pick-up apparatus 100 according to the present embodiment provides the sweet spot, which is symmetric (bilaterally symmetric) about the center line L1. This makes it possible to intuitively and easily understand the range of the sound pick-up area (sweet spot).

As described above, the sound pick-up apparatus 100 according to the present embodiment performs the process of selecting the main microphone array depending on the target area sound amplitude spectrum correction coefficients.

Figure 5:
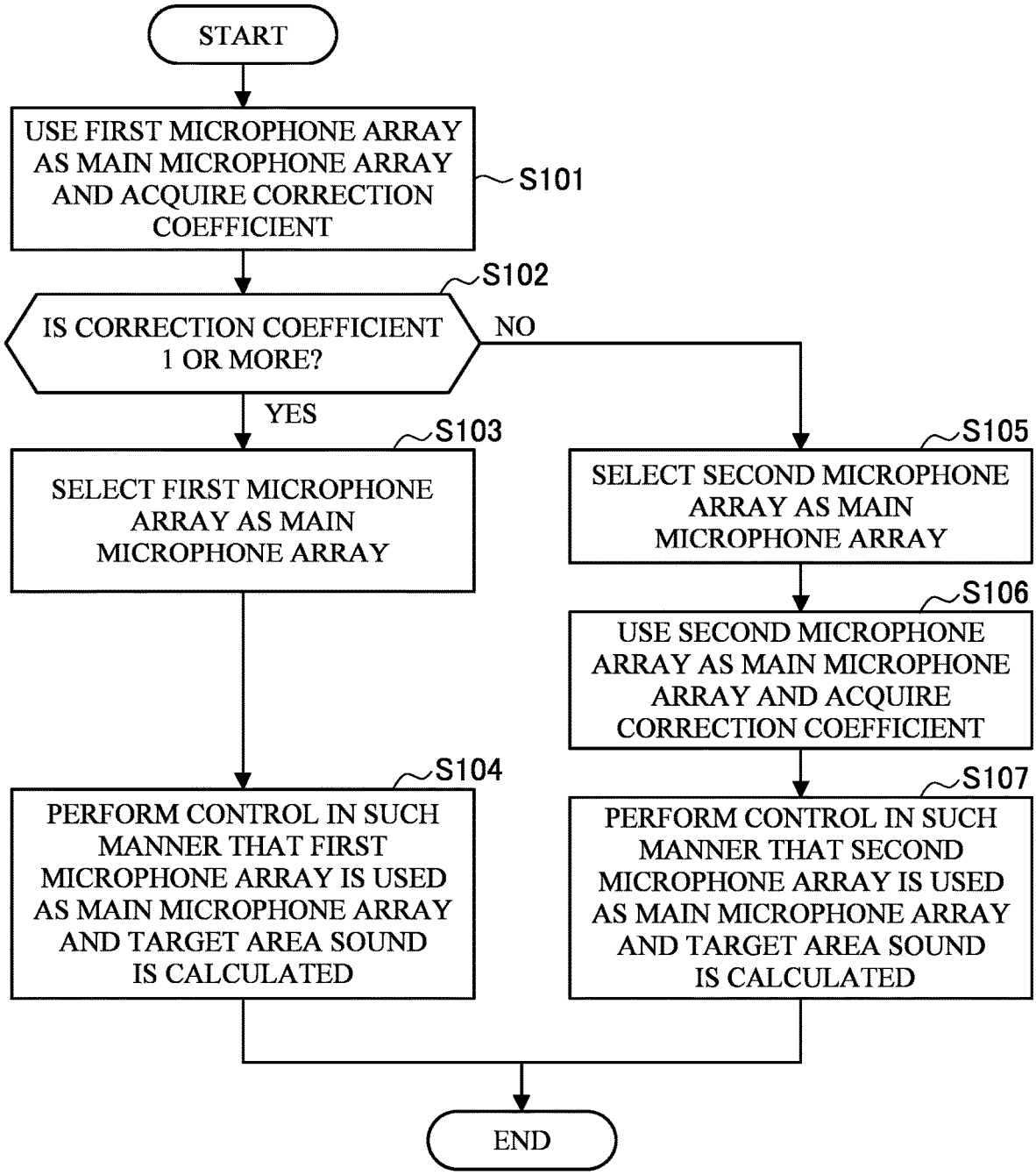
FIG. 5 is a flowchart illustrating operation of the sound pick-up apparatus according to the first embodiment.

Next, with reference to the flowchart illustrated in FIG. 5, a detailed example of operation of the main microphone array selection unit 106 will be described. Note that, the correction coefficient calculation unit 105 and the target area sound extraction unit 107 also operate under the control of the main microphone array selection unit 106. Note that, hereinafter, the target area sound amplitude spectrum correction coefficient used for calculating the target area sound on the basis of any microphone array will be referred to as a "target area sound amplitude spectrum correction coefficient corresponding to any microphone array".

Here, as described above, the correction coefficient calculation unit 105 according to the present embodiment uses the microphone array MA1 as the main microphone array at first, and calculates the target area sound amplitude spectrum correction coefficient $\alpha_2(n)$ in accordance with the expressions (6) and (8).

First, the main microphone array selection unit 106 acquires a target area sound amplitude spectrum correction coefficient $\alpha_2(n)$ in the case where the microphone array MA1 first calculated by the correction coefficient calculation unit 105 is used as the main microphone array (Step S101). Subsequently, the main microphone array selection unit 106 determines whether or not the acquired target area sound amplitude spectrum correction coefficient $\alpha_2(n)$ is a threshold (here, 1 or more) or more (Step S102). If the first acquired target area sound amplitude spectrum correction coefficient $\alpha_2(n)$ is 1 or more, the main microphone array selection unit 106 performs a process in Step S103 (to be described later). If not, the main microphone array selection unit 106 performs a process in Step S105 (to be described later).

In this case, the correction coefficient calculation unit 105 first acquires the target area sound amplitude spectrum correction coefficient $\alpha_2(n)$ to be used on the basis of the microphone array MA1, and determines whether or not the acquired target area sound amplitude spectrum correction coefficient $\alpha_2(n)$ is 1 or more.

In the case where the target area sound amplitude spectrum correction coefficient $\alpha_2(n)$ to be used when the microphone array MA1 serves as the main microphone array is 1 or more in the above-described Step S102, the main microphone array selection unit 106 selects the microphone array MA1 as the main microphone array (Step S103), and controls the target area sound extraction unit 107 in such a manner that the microphone array MA1 is used as the main microphone array and a target area sound is calculated. In this case, the target area sound extraction unit 107 performs a target area sound extraction process using the above-listed expressions (9) and (11).

On the other hand, in the case where the target area sound amplitude spectrum correction coefficient $\alpha_2(n)$ to be used when the microphone array MA1 serves as the main microphone array is less than 1 in the above-described Step S102, the main microphone array selection unit 106 selects the microphone array MA2 as the main microphone array (Step S105), and causes the correction coefficient calculation unit 105 to calculate the target area sound amplitude spectrum correction coefficient $\alpha_1(n)$ to be used on the basis of the microphone array MA2 (Step S106). Next, the main microphone array selection unit 106 controls the target area sound extraction unit 107 in such a manner that the microphone array MA2 is used as the main microphone array and a target area sound is calculated (Step S107). In this case, the target area sound extraction unit 107 performs a target area sound extraction process using the above-listed expressions (10) and (12).

(A-3) Advantageous Effect According to First Embodiment

The following advantageous effects can be achieved according to the first embodiment.

The sound pick-up apparatus 100 according to the first embodiment selects the main microphone array and extracts the target area sound on the basis of the target area sound amplitude spectrum correction coefficient. This allows the sound pick-up apparatus 100 according to the first embodiment to output a target area sound having the largest sound volume among target area sounds of all the microphone arrays in any case. Therefore, it is possible for the listener to stably hear the target area sound when using the sound pick-up apparatus according to the first embodiment.

In addition, the sound pick-up apparatus 100 according to the first embodiment selects the main microphone array when calculating the target area sound amplitude spectrum correction coefficient. Therefore, the target area sound extraction process is performed only once, and this makes it possible to reduce throughput.

(B) Second Embodiment

Hereinafter, a second embodiment of a sound pick-up apparatus, a sound pick-up program, and a sound pick-up method according to the present invention will be described with reference to drawings.

(B-1) Configuration According to Second Embodiment

FIG. 4 is a block diagram illustrating a functional configuration of a sound pick-up apparatus 100A according to the second embodiment. In FIG. 4, structural elements that are same as or correspond to the structural elements illustrated in FIG. 1 described above are denoted with the same reference signs or corresponding reference signs. Hereinafter, the sound pick-up apparatus 100A according to the second embodiment will be described while focusing on difference from the first embodiment.

In the case of using the sound pick-up apparatus 100 according to the first embodiment, there is a possibility that the SN ratio deteriorates and sound quality deteriorates although the target area sound has large sound volume when the non-target area sound appears near a microphone array, which is selected as the main microphone array. Therefore, the sound pick-up apparatus 100A according to the second embodiment selects a main microphone array (microphone array serving as a criteria for extracting a target area sound) for each frequency on the basis of the target area sound amplitude spectrum correction coefficients and a target area sound amplitude spectrum ratio of between frequencies obtained when the target area sound amplitude spectrum correction coefficients are calculated.

Specifically, the sound pick-up apparatus 100A according to the second embodiment is different from the sound pick-up apparatus 100 according to the first embodiment in that the main microphone array selection unit 106 is replaced with a frequency-dependent main microphone array selection unit 108.

The frequency-dependent main microphone array selection unit 108 selects a main microphone array (microphone array serving as a criteria for extracting a target area sound) on the basis of the correction coefficients calculated by the correction coefficient calculation unit 105 and target area sound amplitude spectra corresponding to respective frequencies.

(B-2) Operation According to Second Embodiment

Next, operation of the sound pick-up apparatus 100A according to the second embodiment configured as described above (a sound pick-up method according to the second embodiment) will be described.

An overview of an example of a process performed by the frequency-dependent main microphone array selection unit 108 will be described.

Here, in a way similar to the first embodiment, it is assumed that the frequency-dependent main microphone array selection unit 108 selects a main microphone array one time on the basis of the calculated correction coefficient $\alpha_2(n)$. Subsequently, the frequency-dependent main microphone array selection unit 108 controls the correction coefficient calculation unit 105 and also acquires the correction coefficient $\alpha_1(n)$ on the basis of the microphone array MA2.

Figure 7:
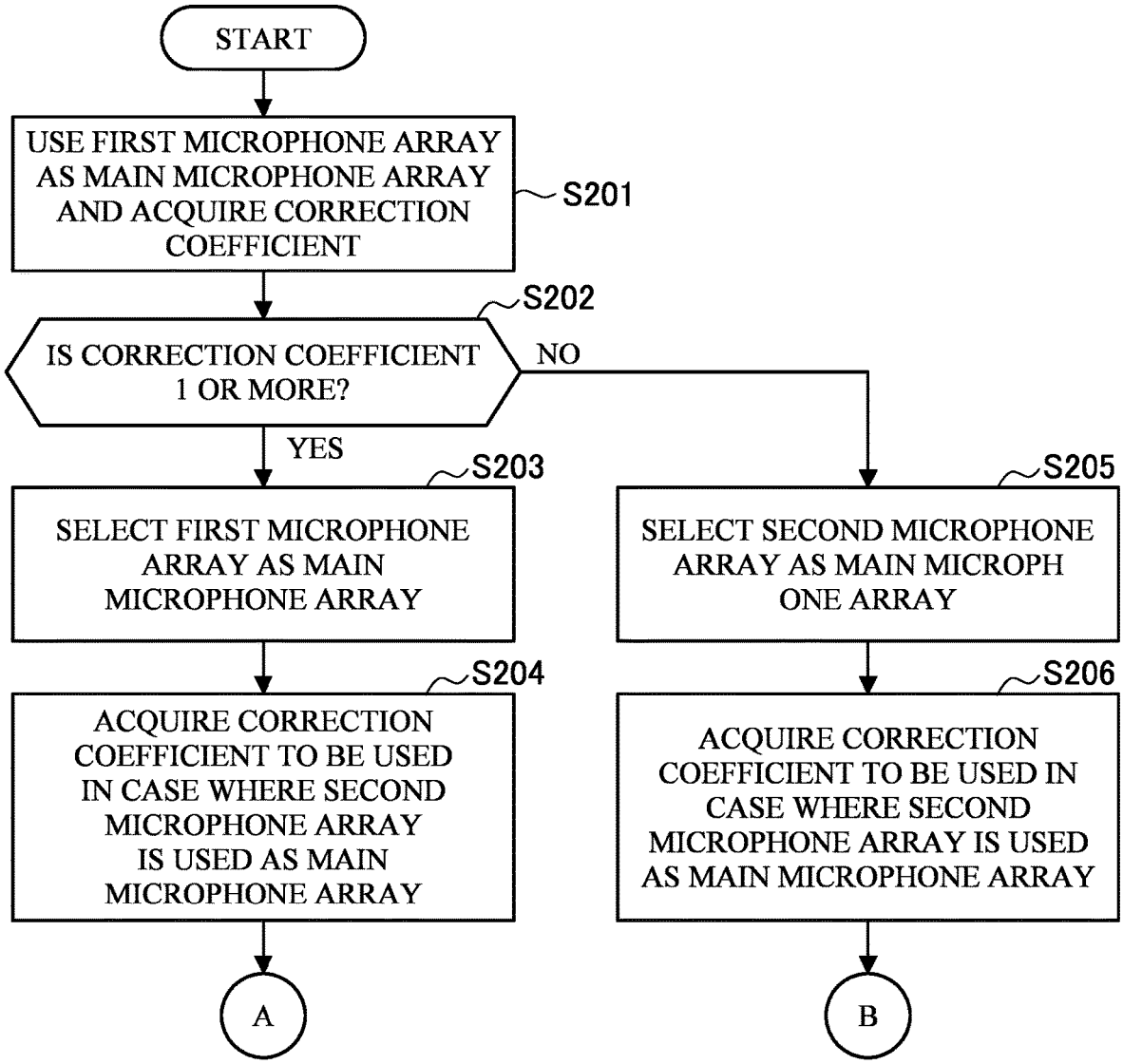
FIG. 7 is a flowchart (part 1) of a main microphone array selection process according to the second embodiment.
Figure 8:
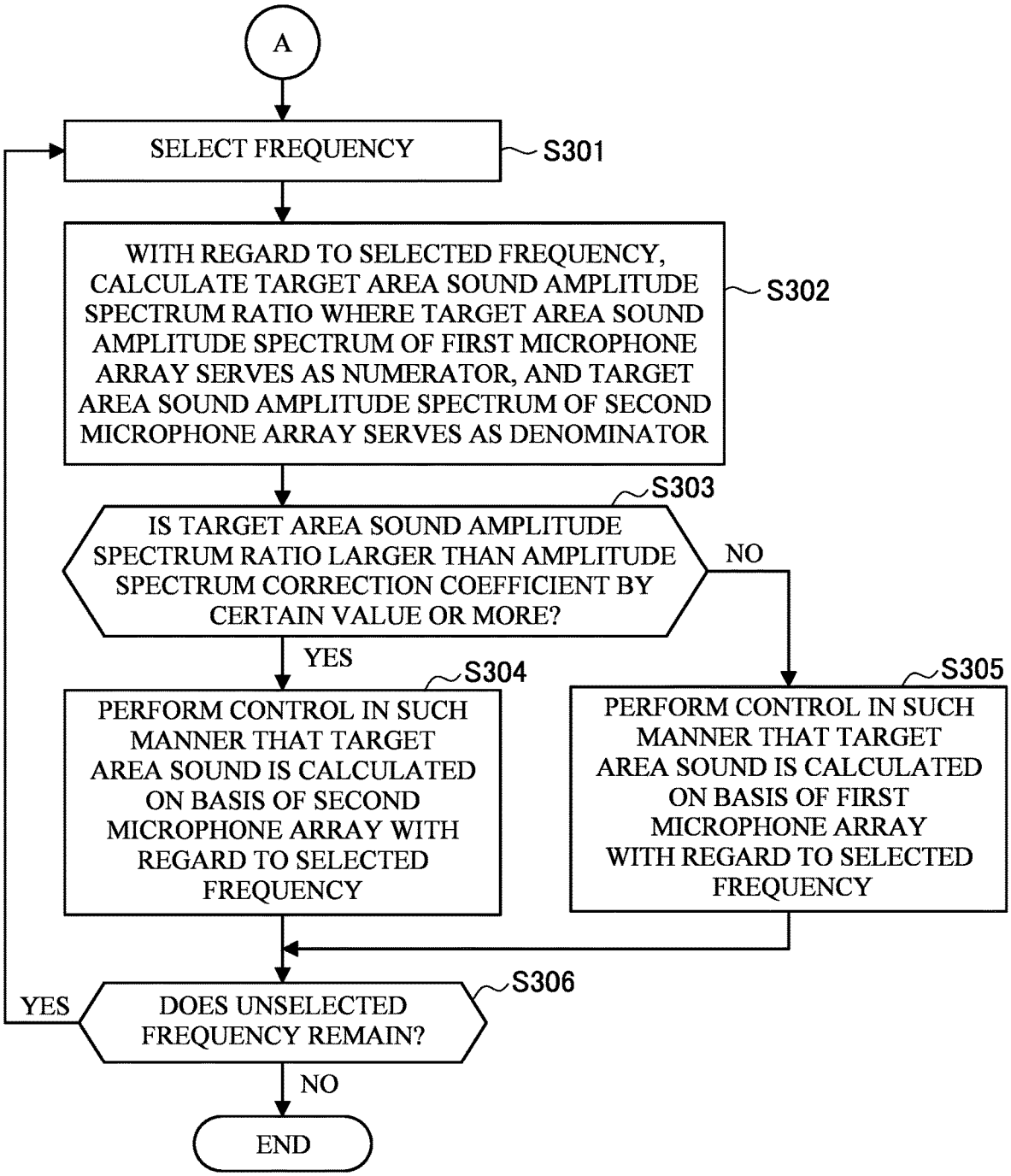
FIG. 8 is a flowchart (part 2) of the main microphone array selection process according to the second embodiment.
Figure 9:
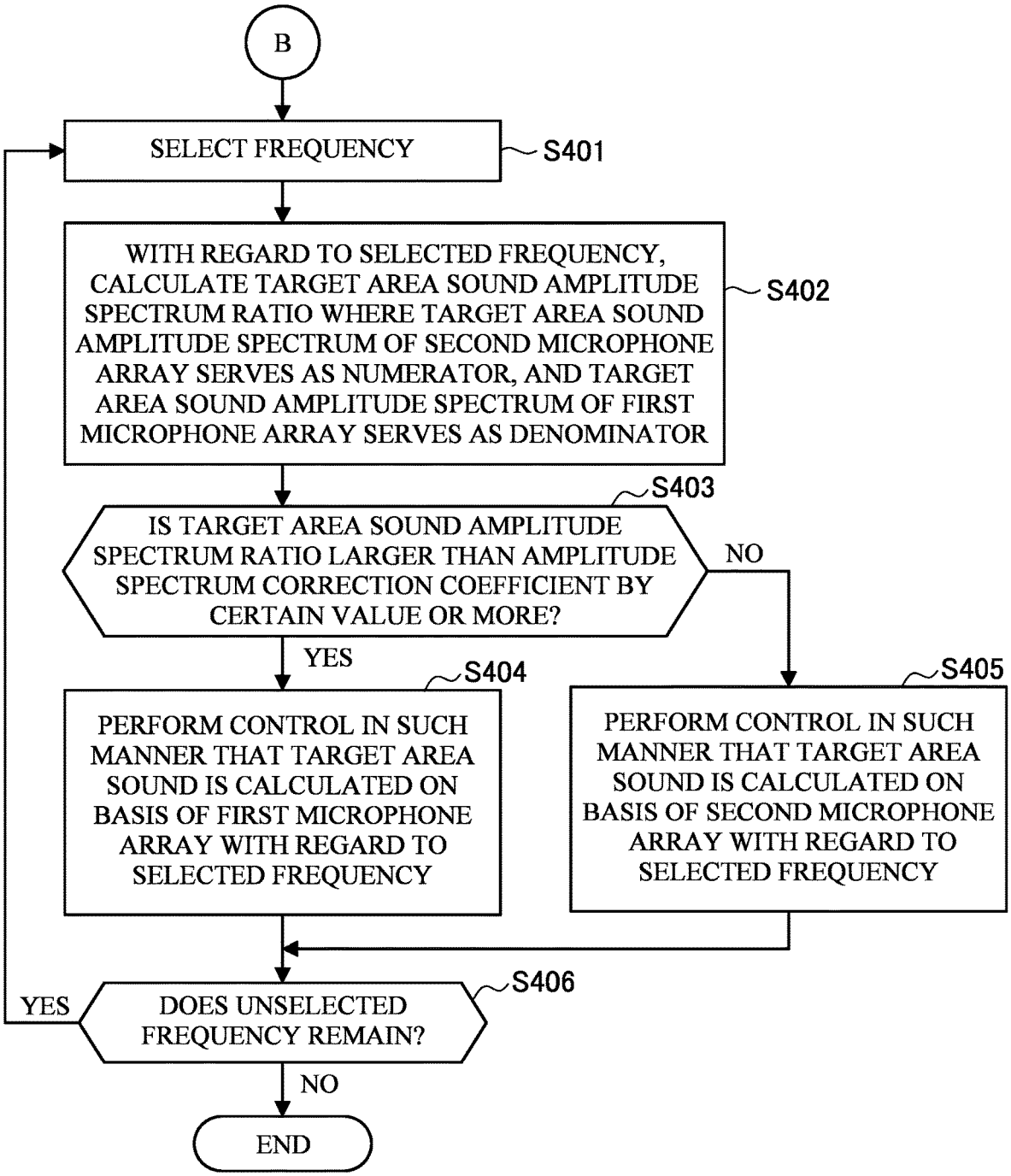
FIG. 9 is a flowchart (part 3) of the main microphone array selection process according to the second embodiment.

Next, the frequency-dependent main microphone array selection unit 108 also selects main microphone arrays (microphone arrays serving as criterion for extracting a target area sound) corresponding to respective frequencies on the basis of the target area sound amplitude spectrum correction coefficients and a target area sound amplitude spectrum ratio between the microphone arrays. For example, in the case where the microphone array MA1 is selected as the main microphone array on the basis of the first determination using the correction coefficient $\alpha_2(n)$, the frequency-dependent main microphone array selection unit 108 compares a target area sound amplitude spectrum ratio $R_{1k}(n)$ ($R_{1k}(n)=Y_{1k}(n)/Y_{2k}(n)$) with a threshold $T_1(n)$ ($T_1(n)=\alpha_2(n)+\tau$) based on $\alpha_2(n)$ with regard to each frequency. For example, in the case where $R_{1k}(n)$ is larger than $T_1(n)$, it is highly possible that the BF output of the microphone array MA1 includes a non-target area sound component. In addition, it is highly possible that BF output of the microphone array MA2 corresponding to frequency k includes no non-target area sound or a non-target area sound that is smaller than the non-target area sound of the microphone array MA2 even if the BF output includes the non-target area sound. Accordingly, in this case, the frequency-dependent main microphone array selection unit 108 changes (corrects) the main microphone array from the microphone array MA1 to microphone array MA2 with regard to the frequency k. On the other hand, in the case where the microphone array MA2 is selected as the main microphone array, the frequency-dependent main microphone array selection unit 108 compares a target area sound amplitude spectrum ratio $R_{2k}(n)=(R_{2k}(n)=Y_{2k}(n)/Y_{1k}(n))$ with a threshold $T_2(n)$ ($T_2(n)=\alpha_2(n)+\tau$) based on $\alpha_1(n)$ with regard to each frequency. In the case where $R_{2k}(n)$ is larger than $T_2$ at this time, the frequency-dependent main microphone array selection unit 108 changes the main microphone array from the microphone array MA2 to microphone array MAL FIG. 7 to FIG. 9 illustrates flowcharts representing the above-described operation performed under the control of the frequency-dependent main microphone array selection unit 108. The flowcharts illustrated in FIG. 7 to FIG. 9 indicate that the correction coefficient calculation unit 105 uses the microphone array MA1 as the main microphone array at first, and calculates the target area sound amplitude spectrum correction coefficient $\alpha_2(n)$ in accordance with the expressions (6) and (8) in a way similar to the first embodiment.

First, the frequency-dependent main microphone array selection unit 108 acquires a target area sound amplitude spectrum correction coefficient in the case where the microphone array MA1 first calculated by the correction coefficient calculation unit 105 is used as the main microphone array (Step S201). Subsequently, the frequency-dependent main microphone array selection unit 108 determines whether or not the acquired target area sound amplitude spectrum correction coefficient is a threshold (here, 1 or more) or more (Step S202). If the first acquired target area sound amplitude spectrum correction coefficient is 1 or more, the frequency-dependent main microphone array selection unit 108 performs a process in Step S203 (to be described later). If not, the frequency-dependent main microphone array selection unit 108 performs a process in Step S205 (to be described later).

In the case where the target area sound amplitude spectrum correction coefficient $\alpha_2(n)$ to be used when the microphone array MA1 serves as the main microphone array is 1 or more in the above-described Step S202, the frequency-dependent main microphone array selection unit 108 selects the microphone array MA1 as the main microphone array (Step S203).

Next, the frequency-dependent main microphone array selection unit 108 causes the correction coefficient calculation unit 105 to calculate the target area sound amplitude spectrum correction coefficient $\alpha_1(n)$ to be used on the basis of the microphone array MA2 (target area sound amplitude spectrum correction coefficient to be used for extracting a target area sound by using the above-listed expressions (10) and (12)) (Step S204), and proceeds to a process in Step S301 (to be described later).

On the other hand, in the case where the target area sound amplitude spectrum correction coefficient $\alpha_2(n)$ to be used when the microphone array MA1 serves as the main microphone array is less than 1 in the above-described Step S202, the frequency-dependent main microphone array selection unit 108 selects the microphone array MA2 as the main microphone array (Step S205). Next, the frequency-dependent main microphone array selection unit 108 causes the correction coefficient calculation unit 105 to calculate the target area sound amplitude spectrum correction coefficient $\alpha_1(n)$ to be used on the basis of the microphone array MA2 (target area sound amplitude spectrum correction coefficient to be used for extracting a target area sound by using the above-listed expressions (10) and (12)) (Step S206), and proceeds to Step S401 (to be described later).

After the above-described process in Step S204, the frequency-dependent main microphone array selection unit 108 selects one of frequencies (selects a frequency for which a target area sound calculation process (to be described later) is not completed. For example, select frequencies in ascending order) (Step S301). Hereinafter, the frequency selected by the frequency-dependent main microphone array selection unit 108 this time will be referred to as "frequency k".

Next, the frequency-dependent main microphone array selection unit 108 calculates a target area sound amplitude spectrum ratio $R_{1k}(n)$ ($R_{1K}(n)=Y_{1K}(n)/Y_{2k}(n)$) with regard to the frequency k selected this time (Step S302). In the target area sound amplitude spectrum ratio $R_{1k}(n)$ ($R_{1K}(n)=Y_{1K}(n)/Y_{2k}(n)$), the target area sound amplitude spectrum $Y_{1K}(n)$ of the first microphone array serves as a numerator, and the target area sound amplitude spectrum $Y_{2k}(n)$ of the second microphone array serves as a denominator.

Next, the frequency-dependent main microphone array selection unit 108 compares the target area sound amplitude spectrum ratio $R_{1k}(n)$ calculated in Step S302 with regard to the frequency k selected this time with the threshold $T_1(n)$ (for example, $T_1(n)=\alpha_2(n)+\tau$)) based on the target area sound amplitude spectrum correction coefficient $\alpha_2(n)$ (Step S303). Here, the frequency-dependent main microphone array selection unit 108 determines whether or not the threshold $T_1(n)$ is larger than the target area sound amplitude spectrum ratio $R_{1k}(n)$ by a certain value (threshold) or more. If the threshold $T_1(n)$ is larger than the target area sound amplitude spectrum ratio $R_{1k}(n)$ by the certain value (threshold) or more, the frequency-dependent main microphone array selection unit 108 performs a process in Step S304 (to be described later). If not (if a difference is less than the threshold), the frequency-dependent main microphone array selection unit 108 performs a process in Step S305 (to be described later). In this case, for example, a preferable value obtained in advance through an experiment is desirably used as the certain value (threshold) to be used for the comparison.

In the case where the threshold $T_1(n)$ is larger than the target area sound amplitude spectrum ratio $R_{1k}(n)$ by a certain value (threshold) or more, the frequency-dependent main microphone array selection unit 108 calculates a target area sound with regard to the frequency k while using the microphone array MA2 as the main microphone array (Step S304), and proceeds to Step S306 (to be described later). In this case, the target area sound extraction unit 107 calculates the target area sound (target area sound component) corresponding to the frequency k by using the above-listed expression (12).

On the other hand. in the case where the threshold $T_1(n)$ is not larger than the target area sound amplitude spectrum ratio $R_{1k}(n)$ by a certain value (threshold) or more, the frequency-dependent main microphone array selection unit 108 calculates a target area sound with regard to the frequency k while using the microphone array MA1 as the main microphone array (Step S305), and proceeds to Step S306 (to be described later). In this case, the target area sound extraction unit 107 calculates the target area sound (target area sound component) corresponding to the frequency k by using the above-listed expression (11).

After the process in Step S304 or S305, the frequency-dependent main microphone array selection unit 108 checks whether or not unselected frequency remains (Step S306). In the case where unselected frequency remains, the frequency-dependent main microphone array selection unit 108 returns to the above-described Step S301.

After the above-described process in Step S206, the frequency-dependent main microphone array selection unit 108 selects one of frequencies (selects a frequency for which the target area sound calculation process (to be described later) is not completed. For example, select frequencies in ascending order) (Step S401). Hereinafter, the frequency selected by the frequency-dependent main microphone array selection unit 108 this time will be referred to as "frequency k".

Next, the frequency-dependent main microphone array selection unit 108 calculates a target area sound amplitude spectrum ratio $R_{2k}(n)$ ($R_{2k}(n)=Y_{2k}(n)/Y_{1k}(n)$) with regard to the frequency k selected this time (Step S402). In the target area sound amplitude spectrum ratio $R_{2k}(n)$ ($R_{2k}(n)=Y_{2k}(n)/Y_{1k}(n)$), the target area sound amplitude spectrum $Y_{2K}(n)$ of the second microphone array serves as a numerator, and the target area sound amplitude spectrum $Y_{1k}(n)$ of the first microphone array serves as a denominator.

Next, the frequency-dependent main microphone array selection unit 108 compares the target area sound amplitude spectrum ratio $R_{2k}(n)$ calculated in Step S402 with regard to the frequency k selected this time with the threshold $T_2(n)$ (for example, $T_2(n)=\alpha_2(n)+\tau$)) based on the target area sound amplitude spectrum correction coefficient $\alpha_1(n)$ (Step S403). Here, the frequency-dependent main microphone array selection unit 108 determines whether or not the threshold $T_2(n)$ is larger than the target area sound amplitude spectrum ratio $R_{2k}(n)$ by a certain value (threshold) or more. If the threshold $T_2(n)$ is larger than the target area sound amplitude spectrum ratio $R_{2k}(n)$ by the certain value (threshold) or more, the frequency-dependent main microphone array selection unit 108 performs a process in Step S404 (to be described later). If not (if a difference is less than the threshold), the frequency-dependent main microphone array selection unit 108 performs a process in Step S405 (to be described later). In this case, for example, a preferable value obtained in advance through an experiment is desirably used as the certain value (threshold) to be used for the comparison.

In the case where the threshold $T_2(n)$ is larger than the target area sound amplitude spectrum ratio $R_{2k}(n)$ by the certain value (threshold) or more, the frequency-dependent main microphone array selection unit 108 calculates a target area sound with regard to the frequency k while using the microphone array MA1 as the main microphone array (Step S404), and proceeds to Step S406 (to be described later). In this case, the frequency-dependent main microphone array selection unit 108 calculates the target area sound (target area sound component) corresponding to the frequency k by using the above-listed expression (11).

On the other hand. in the case where the threshold $T_2(n)$ is not larger than the target area sound amplitude spectrum ratio $R_{2k}(n)$ by the certain value (threshold) or more, the frequency-dependent main microphone array selection unit 108 calculates a target area sound with regard to the frequency k while using the microphone array MA2 as the main microphone array (Step S405), and proceeds to Step S406 (to be described later). In this case, the frequency-dependent main microphone array selection unit 108 calculates the target area sound (target area sound component) corresponding to the frequency k by using the above-listed expression (12).

After the process in Step S404 or S405, the frequency-dependent main microphone array selection unit 108 checks whether or not unselected frequency remains (Step S406). In the case where unselected frequency remains, the frequency-dependent main microphone array selection unit 108 returns to the above-described Step S401.

(B-3) Advantageous Effect According to Second Embodiment

The second embodiment can achieve the following advantageous effects in comparison with the advantageous effects according to the first embodiment.

After the main microphone array is selected, the sound pick-up apparatus 100A according to the second embodiment selects the frequency-dependent main microphone arrays again. This makes it possible to reduce the non-target area sound components and improve the SN ratio. Therefore, it is possible to suppress deterioration in sound quality obtained when extracting the target area sound.

(C) Third Embodiment

Hereinafter, a third embodiment of a sound pick-up apparatus, a sound pick-up program, and a sound pick-up method according to the present invention will be described with reference to drawings.

(C-1) Configuration According to Third Embodiment

Figure 10:
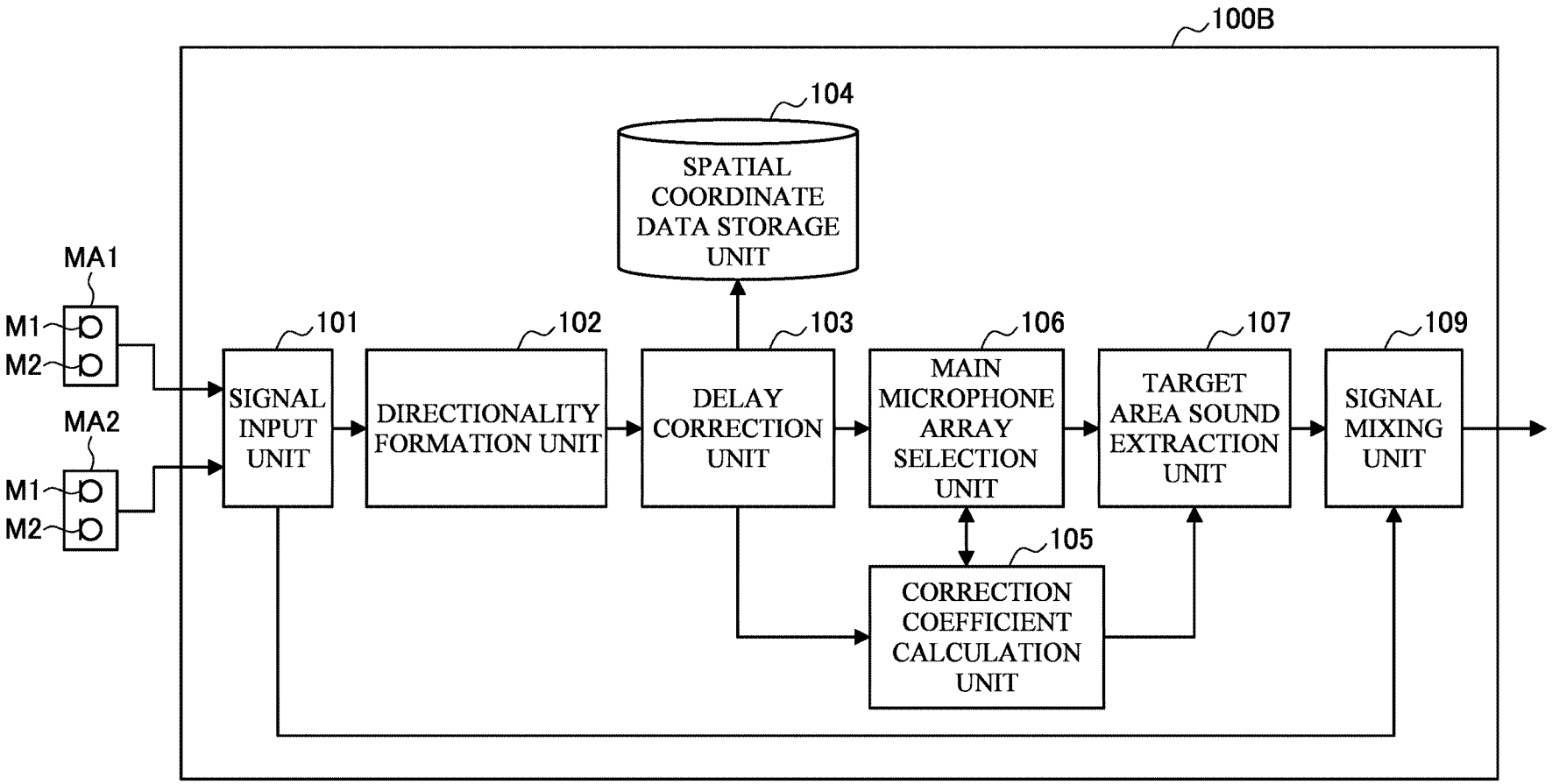
FIG. 10 is a block diagram illustrating a functional configuration of a sound pick-up apparatus according to a third embodiment.

FIG. 10 is a block diagram illustrating a functional configuration of a sound pick-up apparatus 100B according to the third embodiment. In FIG. 10, structural elements that are same as or correspond to the structural elements illustrated in FIG. 1 described above are denoted with the same reference signs or corresponding reference signs. Hereinafter, the sound pick-up apparatus 100B according to the third embodiment will be described while focusing on difference from the first embodiment.

First, structural elements of the sound pick-up apparatus 100B according to the third embodiment will be described.

In the case where background noise and non-target area sound have high sound volume level, there is a possibility that the SS for extracting a target area sound may distort the target area sound or may generate weird strident noise such as musical noise. Alternatively, when using a technology described in reference literature 1 (JP 2017-183902A), respective sound volume levels of an input signal and estimated noise of a microphone are adjusted in accordance with volumes of background noise and non-target area sound, and are mixed with extracted target area sound.

The process of extracting target area sounds produces a stronger musical noise as the sound volume levels of background noise and non-target area sounds grow higher. Therefore, when using the technology described in the reference literature 1, the total sound volume level of input signals and estimated noise to mix is raised in proportion to the sound volume levels of background noise and non-target area sounds. Specifically, when using the technology described in the reference literature 1, the sound volume level of background noise is calculated on the basis of estimated noise obtained in the process of reducing the background noise. In addition, when using the technology described in the reference literature 1, the sound volume level of the non-target area sounds is calculated on the basis of a mixture of non-target area sounds in directions other than the target area direction and non-target area sounds in the target area direction extracted during a process of emphasizing the target area sound. In addition, when using the technology described in the reference literature 1, the ratio of input signals to estimated noise to mix is decided on the basis of the sound volume levels of the estimated noise and non-target area sounds.

If the non-target area sound is located close to the target area and the sound volume level of the input signal to mix is too high, the non-target area sound gets mixed with the target area sound. As a result, it is no longer possible to tell which the target area sound is. Therefore, when using the technology described in the reference literature 1, the sound volume level of input signal to mix is lowered and the sound volume level of estimated noise to mix is raised, and the input signal and the estimated noise are mixed in the case where the non-target area sound is large. In other words, according to the technology described in the reference literature 1, if there is no non-target area sound or the sound volume level of non-target area sounds is low, input signals and estimated noise are mixed at an increased ratio of the input signals. Conversely, if the sound volume level of non-target area sounds is high, input signals and estimated noise are mixed at an increased ratio of the estimated noise.

As described above, when using the technology described in the reference literature 1, it is possible to mask musical noise by mixing the input signals and the estimated noise with the target area sounds, thereby allowing the musical noise to sound natural like normal background noise. In addition, when using the technology described in the reference literature 1, it is possible to correct the distortion of the target area sounds and improve the sound quality by using a target area sound component included in a microphone input signal.

However, when using the technology described in the reference literature 1, the level of input signals to mix is lowered in the case where the non-target area sounds are located close to the target area. This makes it possible to reduce the non-target area sounds mixed with the target area sound. However, this decreases the advantageous effect of reducing the distortion of the target area sound.

Therefore, for example, by applying a configuration example (hereinafter referred to as "first configuration example") in which an input signal having the smallest average target area sound amplitude spectrum (average value of frequency components (target area sound amplitude spectra) of a part or all of the band of the input signal) is selected as a mixing signal among the input signals of the respective microphone arrays, it is possible to reduce the non-target area sounds mixed with the target area sound and to reduce the distortion of the target area sound even when the non-target area sounds are located close to the target area.

Figure 11A:
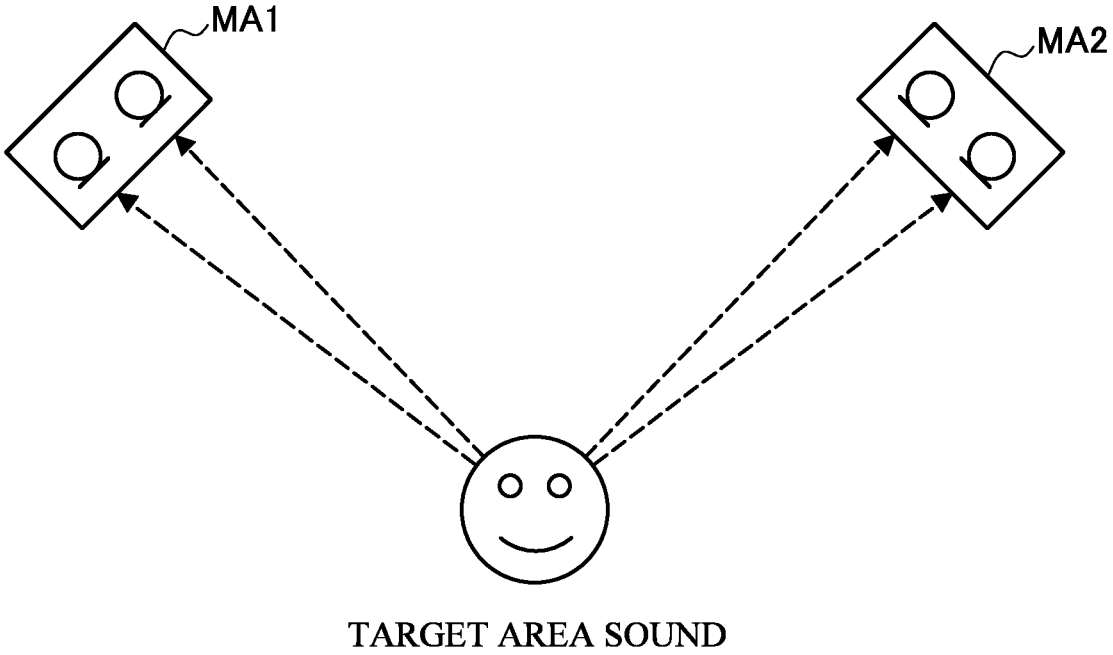
FIG. 11A is an explanatory diagram illustrating an advantageous effect according to the third embodiment.
Figure 11B:
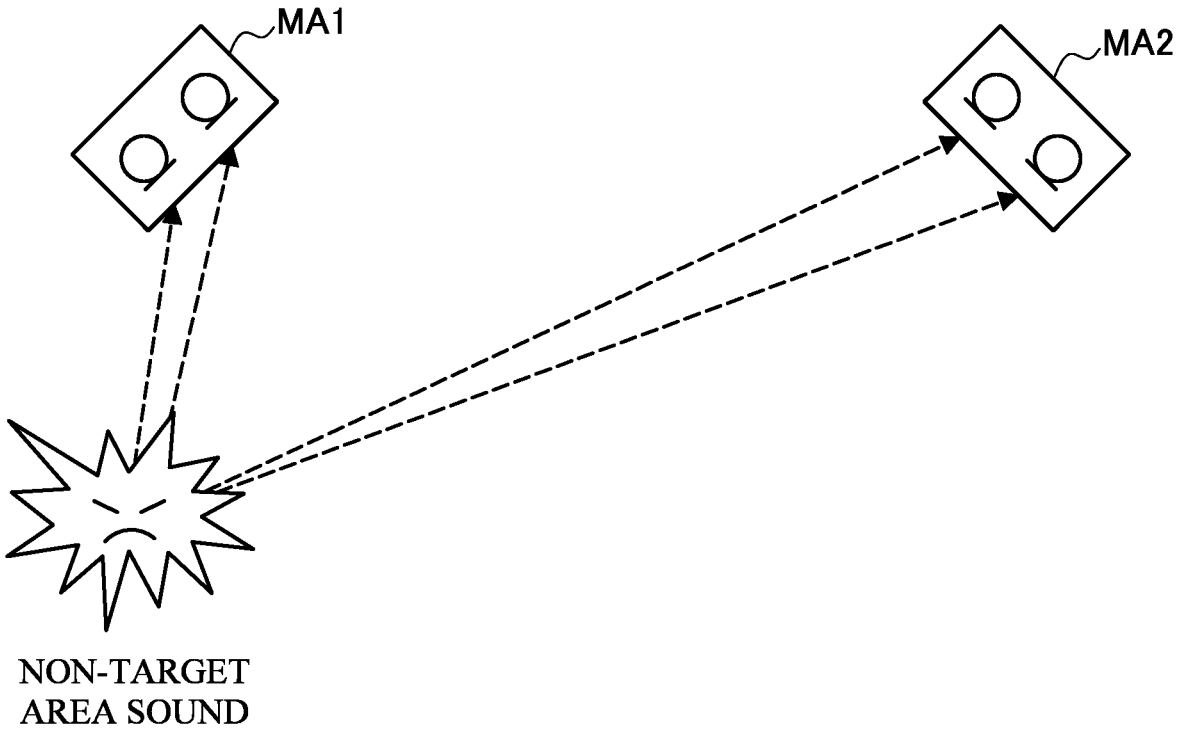
FIG. 11B is an explanatory diagram illustrating an advantageous effect according to the third embodiment.

Here, for example, it is assumed that distances between the center of the sound pick-up area and the respective microphone arrays are equal to each other. In addition, here, for example, it is assumed that the target area sound of the same sound volume is input to all the microphones included in each microphone array. On the other hand, distances between the position of the non-target area sound and the respective microphone arrays are different from each other. Therefore, distance decay varies the volume of the non-target area sound included in signals of the respective microphone arrays. In addition, in the case where the non-target area sound is located at a position other than the front of the microphone array, distances between the non-target area sound and the respective microphones that constitute the single microphone array are different from each other, and different sound volumes are obtained (see FIG. 11B). In other words, an input signal of a microphone located at a farthest position from the non-target area sound includes smallest non-target area sound. In this case, all the microphones collect the target area sound of the same sound volume. Therefore, an input signal having the smallest average target area sound amplitude spectrum has a highest SN ratio among all the microphones. Therefore, in the first configuration example, it is possible to achieve advantageous effects of reducing the non-target area sound mixed with the target area sound and reducing the distortion of the target area sound even in the case where the non-target area sound is located near the target area.

Therefore, in view of the first configuration example described above, the sound pick-up apparatus 100B according to the third embodiment further includes a signal mixing unit 109 configured to mix an input signal component of any microphone of any microphone array with an output from the target area sound extraction unit 107 (extracted target area sound) as a mixing signal.

In the first configuration example, the distortion and the musical noise are reduced by mixing the input signal with the extracted target area sound. In addition, in the first configuration example, an input signal having the smallest average target area sound amplitude spectrum is selected from among the input signals of the microphones to reduce the non-target area sound mixed with the target area sound. However, in the first configuration example, if the main microphone array for extracting the target area sound is different from the selected microphone array, the phase of the main microphone array is different from the phase of the selected microphone array, and there is a possibility of affecting the sound quality at the time of mixing. In addition, in the first configuration example, the average target area sound amplitude spectra of all the microphones are calculated and compared with each other. Therefore, if the number of microphones constituting each microphone array increases, the amount of calculation increases by the number of added microphones.

Therefore, the signal mixing unit 109 according to the third embodiment uses an input signal of one of the microphones constituting the main microphone array selected by the main microphone array selection unit 106, as the mixing signal.

(C-2) Operation According to Third Embodiment

Next, operation of the sound pick-up apparatus 100B according to the third embodiment configured as described above (a sound pick-up method according to the third embodiment) will be described while focusing on difference from the first embodiment.

The third embodiment is different from the first embodiment only in that the sound pick-up apparatus 100B according to the third embodiment further includes the signal mixing unit 109. Hereinafter, only the operation of the signal mixing unit 109 will be described.

The signal mixing unit 109 mixes the input signal of the microphone constituting the microphone array selected by the main microphone array selection unit 106 with the target area sound extracted by the target area sound extraction unit 107, as the mixing signal. In this case, the signal mixing unit 109 may mix the mixing signal without any change, or may mix the mixing signal multiplied by a predetermined coefficient. At this time, any mixing signal can be used as long as the mixing signal is an input signal of a microphone constituting the selected microphone array. Therefore, the signal mixing unit 109 may decide in advance which input signal to use as the mixing signal, or may treat an average of input signals of all microphones of a selected main microphone array as the mixing signal.

(C-3) Advantageous Effect According to Third Embodiment

The third embodiment can achieve the following advantageous effects in comparison with the advantageous effects according to the first embodiment.

The sound pick-up apparatus 100B according to the third embodiment decides the mixing signal on the basis of the selection of the main microphone array. Therefore, the phase of the target area sound becomes the same as the phase of the mixing signal, and this makes it possible to reduce effects on the sound quality. It is also possible to reduce the amount of calculation for selecting the mixing signal.

(C) Fourth Embodiment

Hereinafter, a fourth embodiment of a sound pick-up apparatus, a sound pick-up program, and a sound pick-up method according to the present invention will be described in detail with reference to drawings.

(C-1) Configuration According to Fourth Embodiment

Figure 6:
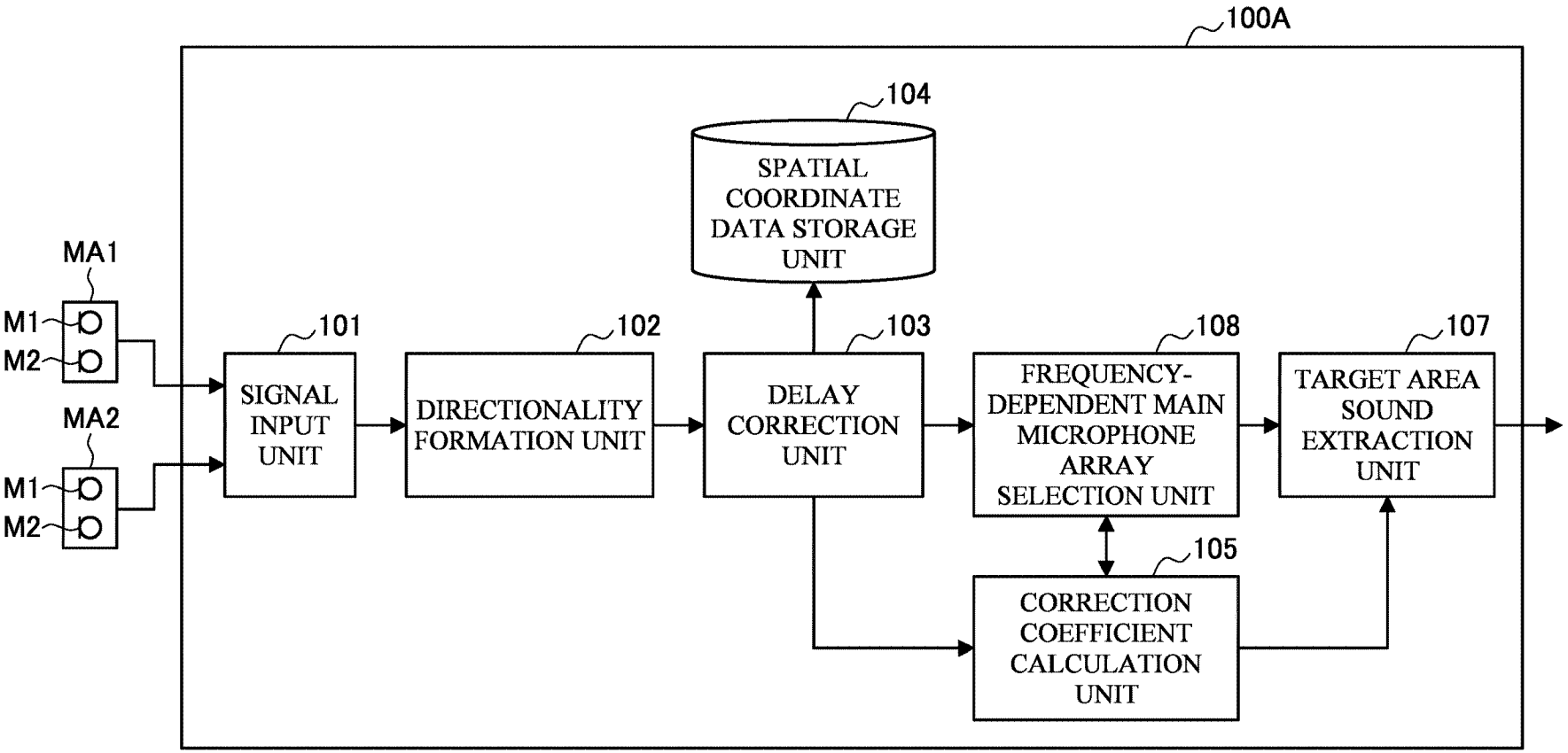
FIG. 6 is a block diagram illustrating a functional configuration of a sound pick-up apparatus according to a second embodiment.
Figure 12:
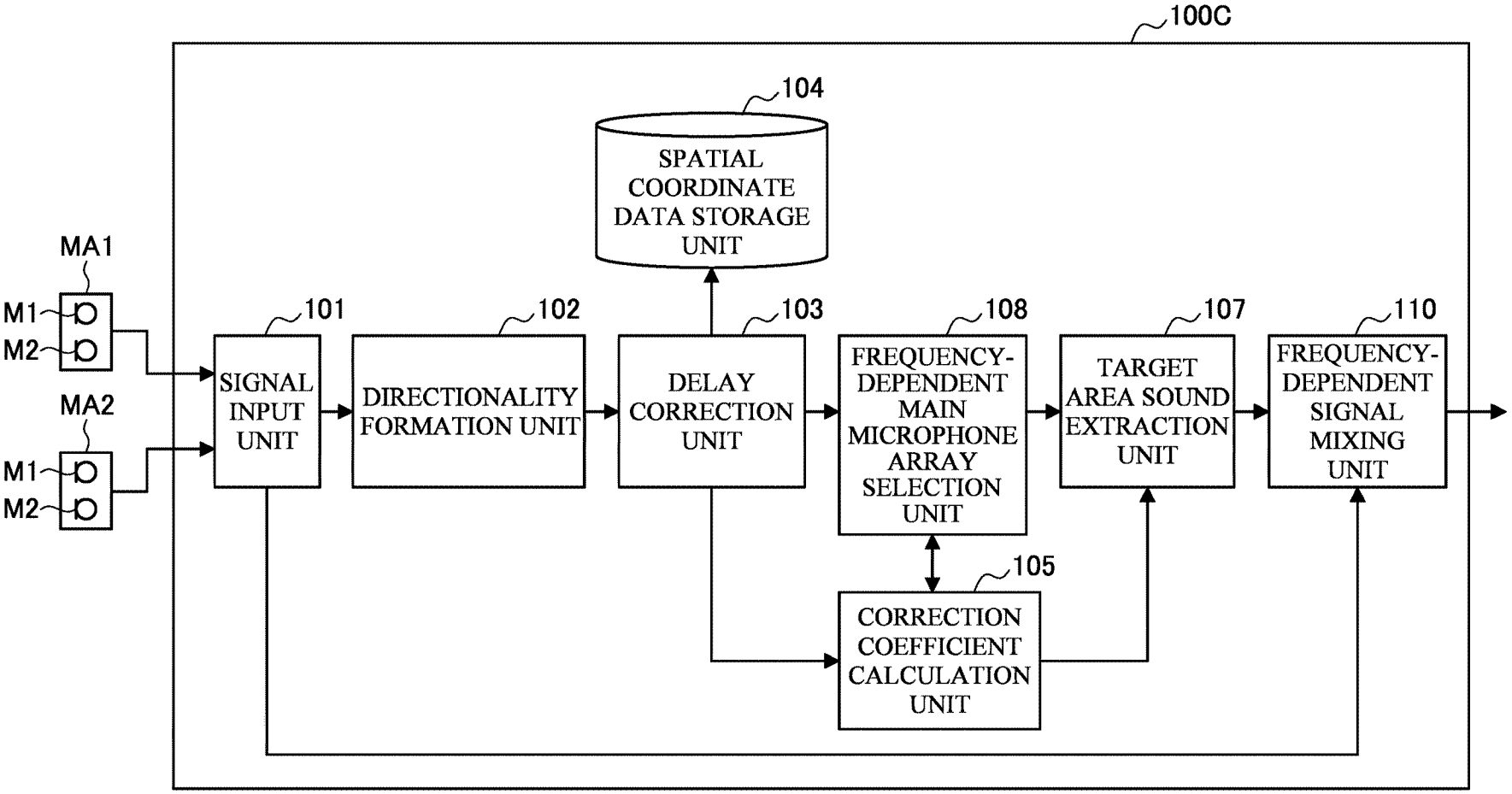
FIG. 12 is a block diagram illustrating a functional configuration of a sound pick-up apparatus according to a fourth embodiment.
Figure 13:
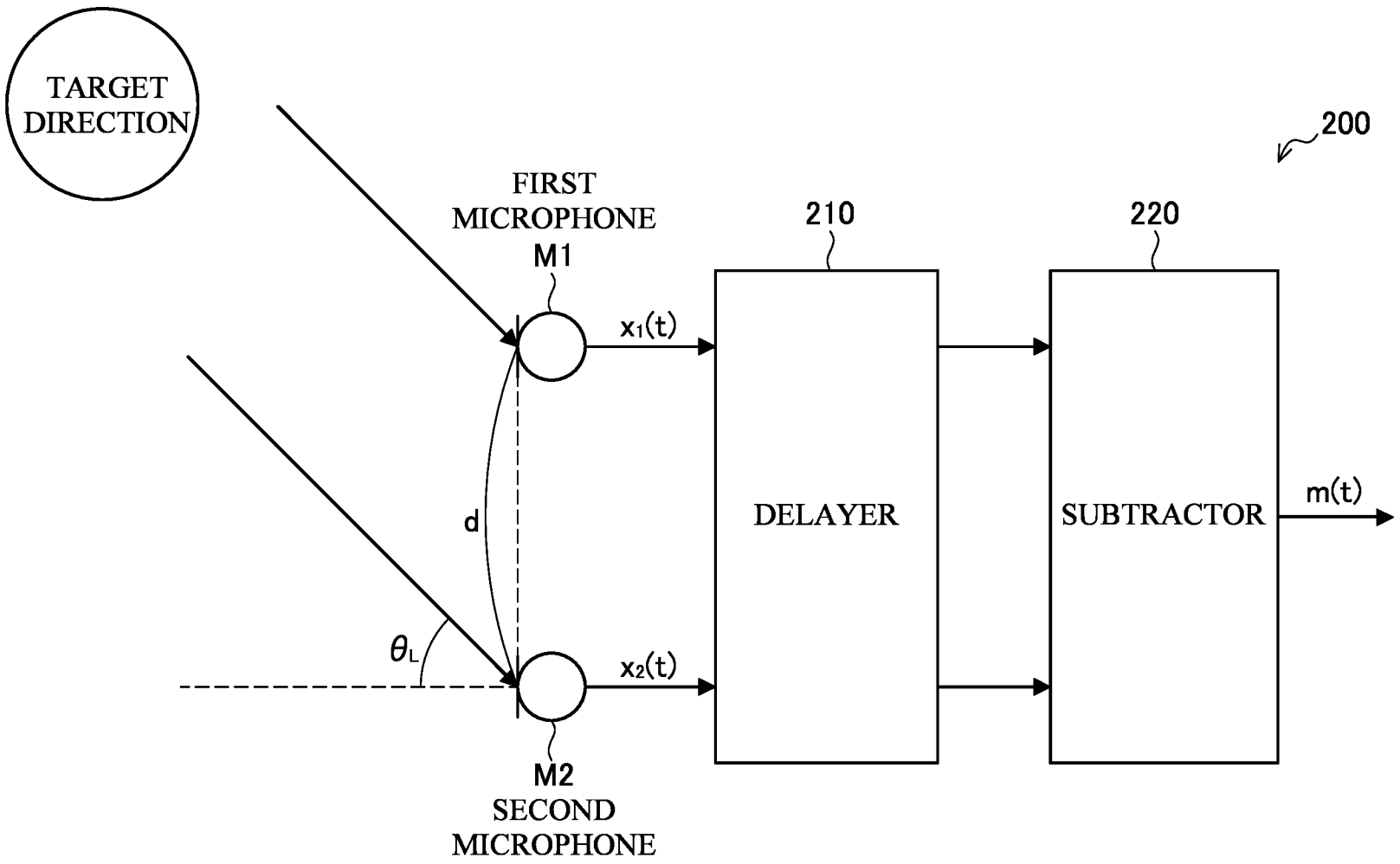
FIG. 13 is a block diagram illustrating a configuration of a conventional subtraction-type BF.
Figure 14A:
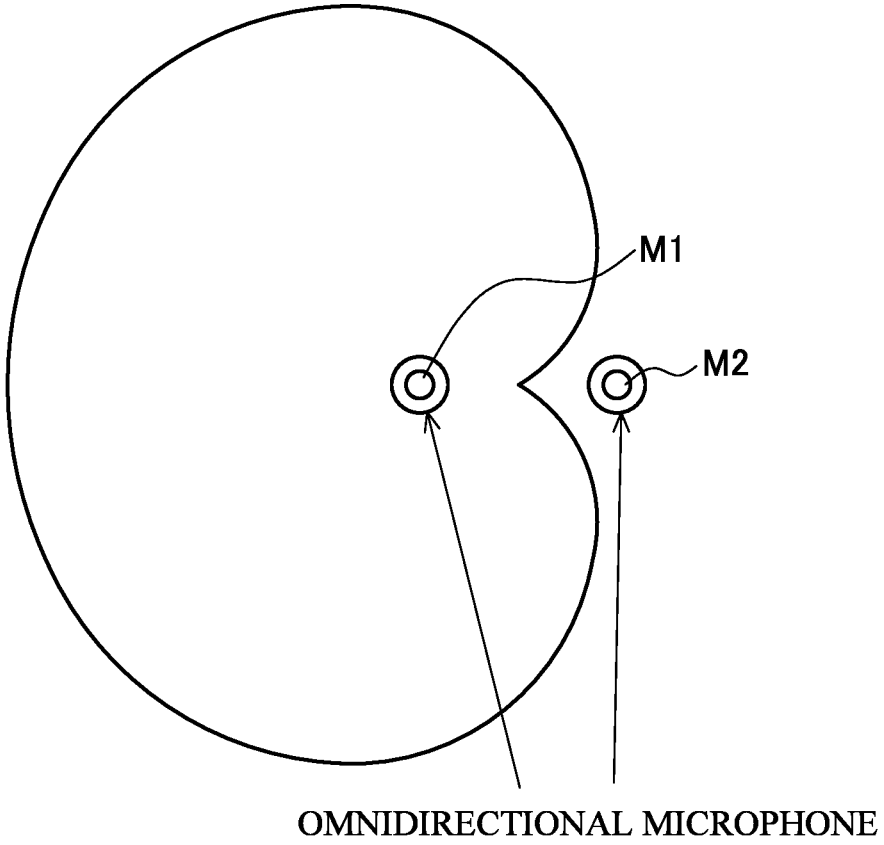
FIG. 14A is an explanatory diagram illustrating an example of a directional filter formed by the conventional subtraction-type BF.
Figure 14B:
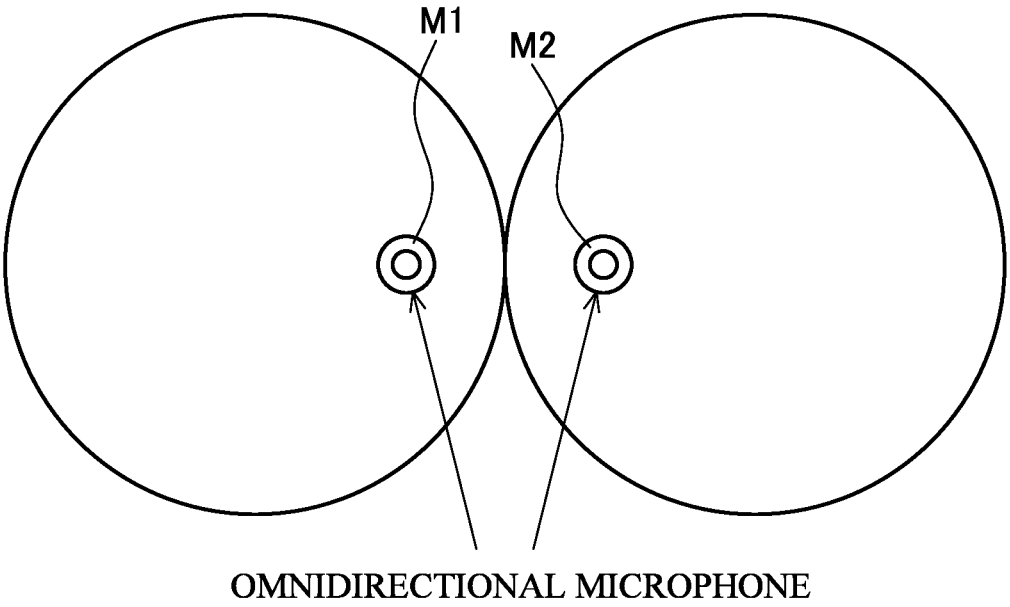
FIG. 14B is an explanatory diagram illustrating an example of the directional filter formed by the conventional subtraction-type BF.

FIG. 12 is a block diagram illustrating a functional configuration of a sound pick-up apparatus 100C according to the fourth embodiment. In FIG. 12, structural elements that are same as or correspond to the structural elements illustrated in FIG. 6 described above are denoted with the same reference signs or corresponding reference signs. Hereinafter, the sound pick-up apparatus 100C according to the fourth embodiment will be described while focusing on difference from the second embodiment.

First, structural elements of the sound pick-up apparatus 100C according to the fourth embodiment will be described.

As described above, when using the technology described in the reference literature 1, the level of input signals to mix is lowered in the case where the non-target area sounds are located close to the target area. This makes it possible to reduce the non-target area sounds mixed with the target area sound. However, this decreases the advantageous effect of reducing the distortion of the target area sound.

Therefore, for example, by applying a configuration example (hereinafter referred to as "second configuration example") in which an input signal of each microphone array having the smallest target area sound amplitude spectrum is selected as the mixing signal with regard to each frequency, it is possible to reduce the non-target area sounds mixed with the target area sound and to reduce the distortion of the target area sound even when the non-target area sounds are located close to the target area.

As described above with reference to FIG. 11, an input signal of a microphone located at a farthest position from the non-target area sound includes smallest non-target area sound. Accordingly, all the microphones collect the target area sound of the same sound volume. Therefore, a frequency component of an input signal having the smallest target area sound amplitude spectrum has a highest SN ratio among all the microphones. Therefore, in the above-described second configuration example, it is possible to achieve advantageous effects of reducing the non-target area sound mixed with the target area sound and reducing the distortion of the target area sound even in the case where the non-target area sound is located near the target area.

However, in the second configuration example, if the main microphone array for extracting the target area sound is different from the selected microphone array, the phase of the main microphone array is different from the phase of the selected microphone array, and there is a possibility of affecting the sound quality at the time of mixing.

Therefore, in view of the problem of the second configuration example described above, the sound pick-up apparatus 100C according to the fourth embodiment further includes a frequency-dependent signal mixing unit 110 configured to mix an input signal component of any microphone of any microphone array with an output from the target area sound extraction unit 107 (extracted target area sound) as a mixing signal with regard to each frequency. The frequency-dependent signal mixing unit 110 uses an input signal of one of the microphones constituting the main microphone array selected for each frequency by the main microphone array selection unit 106, as the mixing signal.

(D-2) Operation According to Fourth Embodiment

Next, operation of the sound pick-up apparatus 100C according to the fourth embodiment configured as described above (a sound pick-up method according to the fourth embodiment) will be described while focusing on difference from the second embodiment.

The fourth embodiment is different from the second embodiment only in that the sound pick-up apparatus 100C according to the fourth embodiment further includes the frequency-dependent signal mixing unit 110. Hereinafter, only the operation of the frequency-dependent signal mixing unit 110 will be described.

The frequency-dependent signal mixing unit 110 mixes the input signal of the microphone constituting the microphone array selected for each frequency by the frequency-dependent main microphone array selection unit 108 with the target area sound extracted by the target area sound extraction unit 107, as the mixing signal. At this time, any mixing signal can be used as long as the mixing signal is an input signal of a microphone constituting the selected microphone array. Therefore, the frequency-dependent signal mixing unit 110 may decide in advance which input signal to use as the mixing signal with regard to each microphone array, or may treat an average of input signals of all microphones of a selected main microphone array (input signals of all the microphones at the frequency k) as the mixing signal. Note that, in this case, the frequency-dependent signal mixing unit 110 may mix the mixing signal without any change, or may mix the mixing signal multiplied by a predetermined coefficient.

(D-3) Advantageous Effect According to Fourth Embodiment

The fourth embodiment can achieve the following advantageous effects in comparison with the advantageous effects according to the second embodiment.

The sound pick-up apparatus 100C according to the fourth embodiment decides the mixing signal on the basis of a result of selecting the main microphone array with regard to each frequency. Therefore, the phase of the target area sound becomes the same as the phase of the mixing signal, and this makes it possible to reduce effects on the sound quality.

(E) Other Embodiments

The present invention is not limited to the above-described embodiments. The present invention can be applied to a modified embodiment exemplified as follows.

(E-1) In the above-described embodiments, the sound pick-up apparatus includes two microphones in each microphone array MA for collecting sound. However, it is also possible to collect sound in the target area direction on the basis of acoustic signals collected by using three or more microphones.

REFERENCE SIGNS LIST

100, 100A, 100B, 100C sound pick-up apparatus
101 signal input unit
102 directionality formation unit
103 delay correction unit
104 spatial coordinate data storage unit
105 correction coefficient calculation unit
106 main microphone array selection unit
107 target area sound extraction unit
108 frequency-dependent main microphone array selection unit
109 signal mixing unit
110 frequency-dependent signal mixing unit

The invention claimed is:

1. A sound pick-up apparatus comprising:

a directionality formation means for forming directionality in a target area direction in which a target area is present by using a beamformer with regard to a signal based on an input signal supplied by each of a plurality of microphone arrays, and acquiring a target direction signal from the target area direction with regard to each of the plurality of microphone arrays;

a correction coefficient calculation means for calculating correction coefficients for approximating target area sound components to each other, the target area sound components being included in the respective target direction signals of the plurality of microphone arrays;

a selection means for selecting a main microphone array on a basis of the correction coefficients calculated by the correction coefficient calculation means, the main microphone array being to be used as a criterion for extracting target area sound; and a target area sound extraction means for correcting the target direction signals of the respective microphone arrays by using the correction coefficients calculated by the correction coefficient calculation means with respect to a microphone array selected as the main microphone array by the selection means, and extracting the target area sound on a basis of the corrected target direction signals of the respective microphone arrays.

2. The sound pick-up apparatus according to claim 1, wherein the selection means selects a first microphone array as the main microphone array in a case where a correction coefficient to be used when the first microphone array serves as the main microphone array is a threshold or more, and the selection means selects a second microphone array as the main microphone array in a case where the correction coefficient to be used when the first microphone array serves as the main microphone array is less than the threshold.

3. The sound pick-up apparatus according to claim 1, wherein, for each frequency, the selection means selects any of the microphone arrays on a basis of a difference between a correction coefficient corresponding to the main microphone array and a target area sound amplitude spectrum ratio using the correction coefficient corresponding to the main microphone array as a numerator, and causes the target area sound extraction means to extract a target area sound component with respect to the microphone array selected for each frequency.

4. The sound pick-up apparatus according to claim 3, wherein, for each frequency, the selection means selects a microphone array that is different from the main microphone array if the target area sound amplitude spectrum ratio using the correction coefficient corresponding to the main microphone array as the numerator is larger than the correction coefficient corresponding to the main microphone array, and the selection means selects the main microphone array if not.

5. The sound pick-up apparatus according to claim 3, further comprising a frequency-dependent signal mixing means for acquiring a component of an input signal of the microphone array selected by the selection means for each frequency, mixing the acquired input signal with the target area sound extracted by the target area sound extraction means, and outputting the input signal mixed with the target area sound.

6. The sound pick-up apparatus according to claim 1, further comprising a signal mixing means for mixing the target area sound extracted by the target area sound extraction means with an input signal from the main microphone array, and outputting the target area sound mixed with the input signal.

7. A non-transitory computer-readable storage medium having recorded thereon a sound pick-up program that causes a computer to functions as:

a directionality formation means for forming directionality in a target area direction in which a target area is present by using a beamformer with regard to a signal based on an input signal supplied by each of a plurality of microphone arrays, and acquiring a target direction signal from the target area direction with regard to each of the plurality of microphone arrays;

a correction coefficient calculation means for calculating correction coefficients for approximating target area sound components to each other, the target area sound components being included in the respective target direction signals of the plurality of microphone arrays;

a selection means for selecting a main microphone array on a basis of the correction coefficients calculated by the correction coefficient calculation means, the main microphone array being to be used as a criterion for extracting target area sound; and a target area sound extraction means for correcting the target direction signals of the respective microphone arrays by using the correction coefficients calculated by the correction coefficient calculation means with respect to a microphone array selected as the main microphone array by the selection means, and extracting the target area sound on a basis of the corrected target direction signals of the respective microphone arrays.

8. A sound pick-up method that is performed by a sound pick-up apparatus, the sound pick-up method comprising:

a directionality formation means; a correction coefficient calculation means; a selection means; and a target area sound extraction means, wherein the directionality formation means forms directionality in a target area direction in which a target area is present by using a beamformer with regard to a signal based on an input signal supplied by each of a plurality of microphone arrays, and acquires a target direction signal from the target area direction with regard to each of the plurality of microphone arrays, the correction coefficient calculation means calculates correction coefficients for approximating target area sound components to each other, the target area sound components being included in the respective target direction signals of the plurality of microphone arrays, the selection means selects a main microphone array on a basis of the correction coefficients calculated by the correction coefficient calculation means, the main microphone array being to be used as a criterion for extracting target area sound, and the target area sound extraction means corrects the target direction signals of the respective microphone arrays by using the correction coefficients calculated by the correction coefficient calculation means with respect to a microphone array selected as the main microphone array by the selection means, and extracts the target area sound on a basis of the corrected target direction signals of the respective microphone arrays.

* * * * *